US011200837B2

(12) United States Patent
Yu et al.

(10) Patent No.: US 11,200,837 B2
(45) Date of Patent: Dec. 14, 2021

(54) OLED DISPLAY DEVICE, AND METHOD FOR CONTROLLING THE OLED DISPLAY DEVICE

(71) Applicant: Hisense Visual Technology Co., Ltd., Shandong (CN)

(72) Inventors: Weijing Yu, Shandong (CN); Mengmeng Lu, Shandong (CN); Xiyu Wang, Shandong (CN); Yang He, Shandong (CN); Guanghua Xue, Shandong (CN); Shaofeng Tan, Shandong (CN); Zaijing Zhang, Shandong (CN); Zhi Cheng, Shandong (CN); Xiaodong Bai, Shandong (CN)

(73) Assignee: HISENSE VISUAL TECHNOLOGY CO., LTD., Qingdao (CN)

( * ) Notice: Subject to any disclaimer, the term of this patent is extended or adjusted under 35 U.S.C. 154(b) by 147 days.

(21) Appl. No.: 16/663,032

(22) Filed: Oct. 24, 2019

(65) Prior Publication Data

US 2020/0098309 A1 Mar. 26, 2020

Related U.S. Application Data

(63) Continuation of application No. PCT/CN2019/089139, filed on May 29, 2019.

(30) Foreign Application Priority Data

Sep. 25, 2018 (CN) ..... 201811115226.0
Dec. 27, 2018 (CN) ..... 201811615553.2

(51) Int. Cl.
*G09G 3/3208* (2016.01)

(52) U.S. Cl.
CPC ..... *G09G 3/3208* (2013.01); *G09G 2330/026* (2013.01); *G09G 2330/027* (2013.01)

(58) Field of Classification Search
CPC ..... G09G 3/3208; G09G 2330/026; G09G 2330/027; G09G 2330/028; G09G 2330/02; G09G 2330/021
(Continued)

(56) References Cited

U.S. PATENT DOCUMENTS

2010/0141632 A1* 6/2010 Li ..... G09G 5/00 345/212
2013/0246815 A1 9/2013 Uehara
(Continued)

FOREIGN PATENT DOCUMENTS

CN 102685420 A 9/2012
CN 103514057 A 1/2014
(Continued)

OTHER PUBLICATIONS

First Office Action and English translation for corresponding Chinese Appl. No. CN201811615553.2 dated Aug. 4, 2020 with English translation, 19 pages.
(Continued)

*Primary Examiner* — Jason M Mandeville
(74) *Attorney, Agent, or Firm* — Crowell & Moring LLP

(57) ABSTRACT

The application discloses an OLED display device and a method for controlling the OLED display device. The OLED display device includes: a first switch element electrically connected respectively with a standby voltage terminal of the power board, and a standby voltage terminal of the main chip, and configured to control the standby voltage terminal of the power board to connect with or disconnect from the standby voltage terminal of the main chip; and a first control element electrically connected respectively with the first switch element, the power board, and the main chip, and configured to receive an AC detection signal output by the power board, and a DC detection signal output by the main
(Continued)

chip, and to control the first switch element to turn on or cut off.

12 Claims, 22 Drawing Sheets

(58) Field of Classification Search
USPC ..... 345/211–212
See application file for complete search history.

(56) References Cited

U.S. PATENT DOCUMENTS

| | | | | |
|---|---|---|---|---|
| 2014/0354168 | A1 | 12/2014 | Hyeon et al. | |
| 2015/0371601 | A1 | 12/2015 | Kim | |
| 2019/0114969 | A1* | 4/2019 | Hong | H02M 7/42 |

FOREIGN PATENT DOCUMENTS

| | | | |
|---|---|---|---|
| CN | 103731618 | A | 4/2014 |
| CN | 103889118 | A | 6/2014 |
| CN | 104118895 | A | 1/2015 |
| CN | 104808758 | A | 7/2015 |
| CN | 205378058 | U | 7/2016 |
| CN | 106095042 | A | 11/2016 |
| CN | 205751476 | U | 11/2016 |
| CN | 108964431 | A | 12/2018 |
| CN | 109688355 | A | 4/2019 |
| WO | WO2018058861 | A1 | 4/2018 |

OTHER PUBLICATIONS

International search report and written opinion regarding PCT/CN2019/089139 dated Aug. 28, 2018, 11 pages.
European Search Report and written opinion regarding EP 19 19 9008 dated Feb. 18, 2020, 10 pages.

* cited by examiner

--Prior Art--

--Prior Art--

--Prior Art--

--Prior Art--

--Prior Art--

OLED DISPLAY DEVICE, AND METHOD FOR CONTROLLING THE OLED DISPLAY DEVICE

This application is a continuation of International Application No. PCT/CN2019/089139, filed on May 29, 2019, which claims the benefits of Chinese Patent Application No. 201811115226.0 filed with the Chinese Patent Office on Sep. 25, 2018 and Chinese Patent Application No. 201811615553.2 filed with the Chinese Patent Office on Dec. 27, 2018, all of which are hereby incorporated by reference in their entireties.

TECHNOLOGY FIELD

The present application generally relates to display technologies, and particularly to an OLED display device, and a method for controlling the OLED display device.

BACKGROUND

In recent years, the Organic Light-Emitting Diode (OLED) display technology is attracting more and more attention as a new display technology.

SUMMARY

The present application provides an OLED display device, and a method for controlling the OLED display device.

Some embodiments of the application provide an OLED display device including a power board; a main chip; a first switch circuit electrically connected with a standby voltage terminal of the power board, and a standby voltage terminal of the main chip, respectively, and configured to control the standby voltage terminal of the power board to connect with or disconnect from the standby voltage terminal of the main chip; and a first control circuit electrically connected with the first switch circuit, the power board, and the main chip, respectively, and configured to receive an AC detection signal output from the power board, and a DC detection signal output from the main chip, and control the first switch circuit to turn on or cut off. The AC detection signal is a signal for indicating alternating current being switched on or off, and the DC detection signal is a signal for indicating direct current being switched on or off.

Some embodiments of the application provide a method for controlling the OLED display device, the method including: receiving, by a first control circuit electrically connected with a first switch circuit, a power board and a main chip of the OLED display device respectively, an AC detection signal output from the power board, and a DC detection signal output from the main chip; determining, by the first control circuit, a level of the AC detection signal and a level of the DC detection signal; in response to the AC detection signal being at a low level and the DC detection signal being at a high level, controlling, by the first control circuit, the first switch circuit electrically connected with a standby voltage terminal of the power board and a standby voltage terminal of the main chip respectively to cut off to disconnect the standby voltage terminal of the power board from the standby voltage terminal of the main chip.

BRIEF DESCRIPTION OF THE DRAWINGS

In order to make the embodiments of the application more apparent, the drawings to which reference is to be made in the description of the embodiments will be introduced below in brevity, and apparently the embodiments to be described below are only some embodiments of the application. Those ordinarily skilled in the art may further derive the other drawings from these drawings without any inventive effort.

DETAILED DESCRIPTION OF THE EMBODIMENTS

Figure 1A:
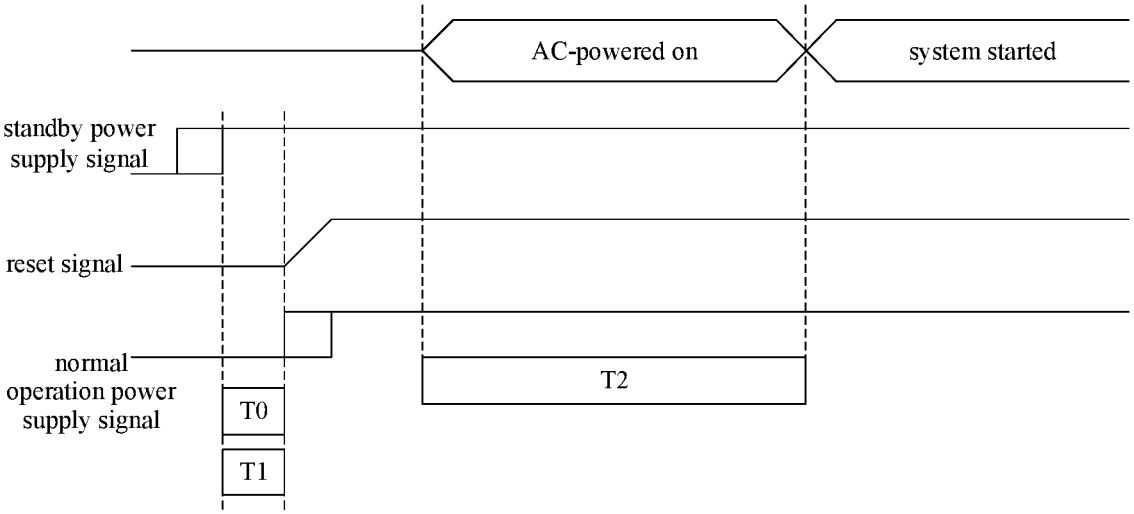
FIG. 1A illustrates a schematic diagram of AC-powering-on timing in the related art.

The embodiments of the application will be described below in further details with reference to the drawings. The exemplary embodiments may be implemented in a number of forms, but shall not be construed as being limited to the embodiments described here. On the contrary, these embodiments are provided to make the disclosure of the application more full and complete, and to completely convey the idea of the embodiments to those skilled in the art. The features, structures, or characteristics to be described may be combined with one or more embodiments. In the following description, numerous specific details will be provided for facilitating understanding of the embodiments of the application. Those skilled in the art shall understand the technical schemes according to the embodiments of the application may be put into implementations while one or more of the specific details is or are omitted, or may be put into implementations in other methods, components, devices, steps, etc.

Moreover the drawings are only schematically illustrative of the application, but may not be necessarily proportional to products. Similar reference numerals in the drawings will refer to identical or like components, so a repeated description thereof will be omitted. Some blocks illustrated in the drawings represent functional modules, but may not necessarily correspond to individual physical or logical modules. These functional modules may be implemented in software, or may be implemented in one or more hardware modules or integrated circuits, or may be implemented in different network and/or processor devices and/or micro control devices.

"Coupled" and "connected" as used in the specification may refer to direct physical contact or electric contact, or indirect physical contact or electric contact between two or more elements. "First", "second", etc., as used in the specification are not intended to suggest a particular order, but only intended to distinguish one element or operation from another to which the same technical term refers. "Include", "comprise", "contain", "have", etc., as used in the specification are open terms, and they refer to "include but not limited to". Direction terms as used in the specification, e.g., "above", "below", "left", "right", "front", "back", etc., only apply to the drawings, so they are not intended to limit the application thereto.

Figure 2:
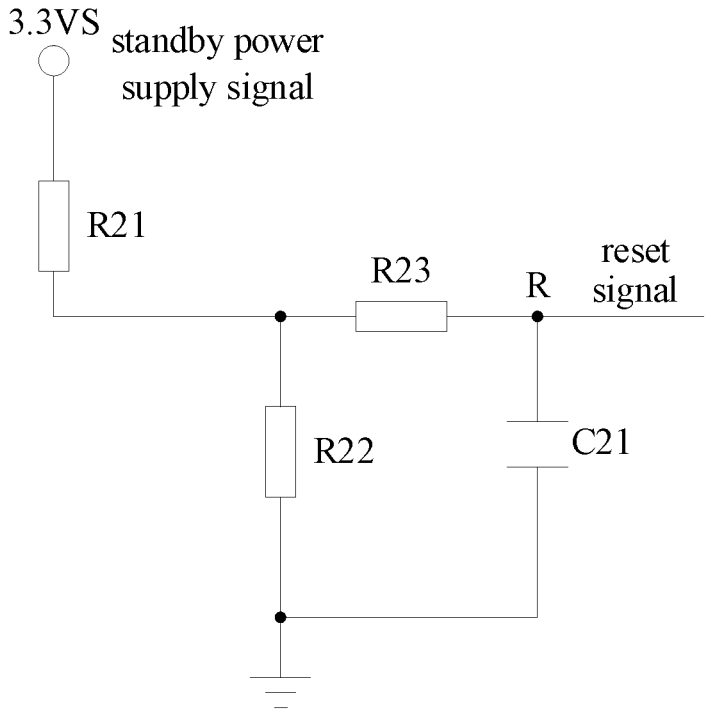
FIG. 2 illustrates a schematic diagram of a reset circuit in the related art.

FIG. 1A illustrates a schematic diagram of AC-powering-on timing of an OLED display device in the related art. As illustrated in FIG. 1A, T0 represents an interval of time (150 μS<T0<1 S) during which a standby power supply signal 3.3VS begins to rise until a reset signal starts to rise. As illustrated in FIG. 2, the level of the reset signal is a level at a node R, and when the standby power supply signal 3.3VS is changed to a high level, the level at the node R begins to rise as an electrolytic capacitor C21 is being charged. So after the standby power supply signal 3.3VS is changed to a high level, the level of the reset signal also rises gradually as the electrolytic capacitor C21 is being charged. T1 represents an interval of time (150 μS<T1<1 S) during which the standby power supply signal 3.3VS begins to rise until a normal operation power supply signal starts to rise, and T2 represents an interval of time (T2>14.1 ms) during which the reset signal and the normal operation power supply signal remain active until a system is started. Apparently in the timing pattern as required above, firstly the standby power supply signal is changed from a low level to a high level, and secondly the reset signal is changed from a low level to a high level, so that the display device may be AC-powered on and thus operate normally. Here, "VS" may refer to a unit of volt for a voltage.

Figure 15:
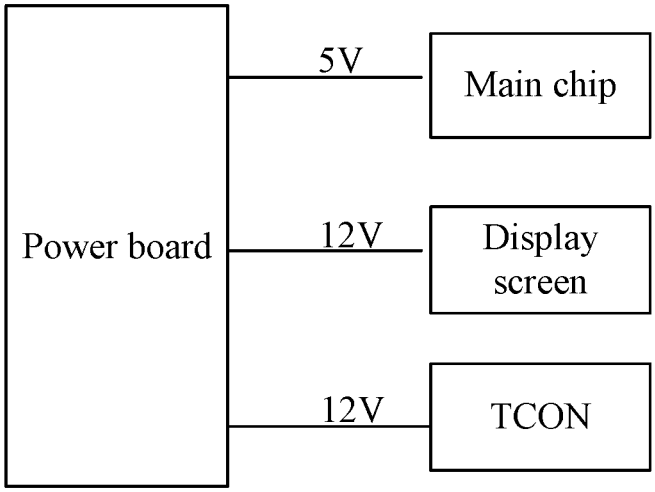
FIG. 15 illustrates a schematic diagram of powering by a power source in the related art.

As illustrated in FIG. 15, a power board for a general display device outputs 5 V as a standby power voltage to power a main chip, and outputs 12 V as a power voltage of a display panel and a Timer Control Register (TCON). While the display device is on standby, the power board switches off the 12 V power supply to the display panel and the TCON, and only maintains the 5 V power supply to the main chip to thereby lower standby power consumption. Due to the characteristic of the OLED panel, in order to protect the OLED panel, the display panel shall be powered for a period of time after the OLED display device is powered off (AC-powered off or DC-powered off), so the power board shall be additionally arranged with a large number of electrolytic capacitors for being discharged to maintain the output power supply.

Figure 1B:
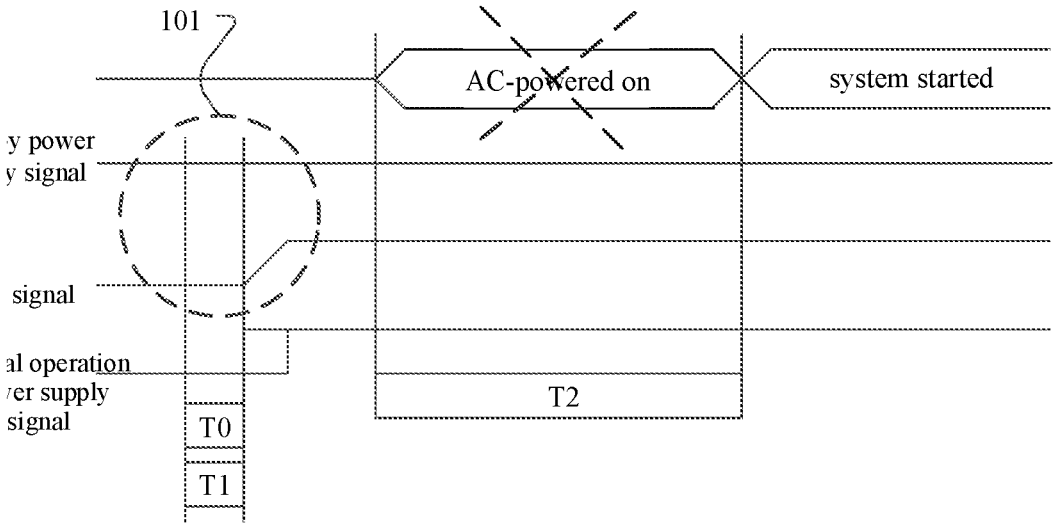
FIG. 1B illustrates a schematic diagram of abnormal AC-powering-on timing in the related art.

However the 5 V/3.3 V power supply (3.3 V is obtained by being converted from 5 V) is maintained for a period of time while the electrolytic capacitors are being discharged to maintain the 12 V power supply, so that neither the 5 V power supply to the main chip nor the standby power supply signal 3.3VS will drop rapidly after the OLED display device is AC-powered off. If the OLED display device is AC-powered on (restarted) at this time, such a situation as illustrated in FIG. 1B will occur: as may be apparent from the circle denoted with the reference numeral 101, the standby power supply signal (3.3VS) is not changed from a low level to a high level, but the reset signal is changed from a low level to a high level while the standby power supply signal is maintained at a high level, and apparently the OLED display device will not be AC-powered on in the normal timing pattern as illustrated in FIG. 1A, so the display device may not be started normally, and thus may be crashed, not responding to operations, etc.

Figure 3:
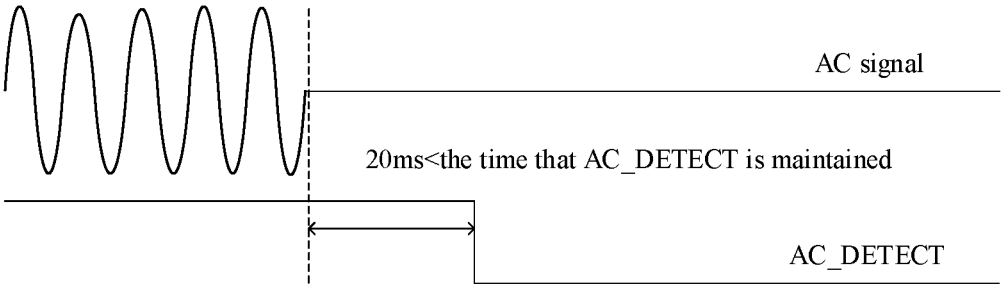
FIG. 3 illustrates a schematic diagram of detecting AC-powering-off using an alternating current (AC) control signal in the related art.

In order to address the problem above that the OLED panel shall be powered for a period of time after the OLED display device is powered off, so the power supply to the main chip will not drop rapidly after the OLED display device is AC-powered off, so that the OLED display device may not be started normally when it is AC-powered on again, i.e., the problem that the 5 V and 3.3 V power supplies will not drop rapidly after the OLED display device is powered off, a switch circuit is arranged in embodiments of the application. When the OLED display device is AC-powered off, the 5 V voltage of a main board is cut off directly via the switch circuit, to thereby cut off the 3.3 V voltage. In this embodiment, a signal shall be sent to the main board to notify the main board when the OLED display device is AC-powered off. In some circuit, after the OLED display device is AC-powered off, the power board outputs an AC_DETECT signal and transmits the AC_DETECT signal to the TCON to instruct the TCON to make a response. As illustrated in FIG. 3, for example, the AC_DE- TECT signal is pulled down approximately 20 ms after the OLED display device is AC-powered off (i.e., AC OFF), so the AC_DETECT signal may be used as a trigger signal of the switch circuit to instruct the switch circuit off or on.

Figure 4:
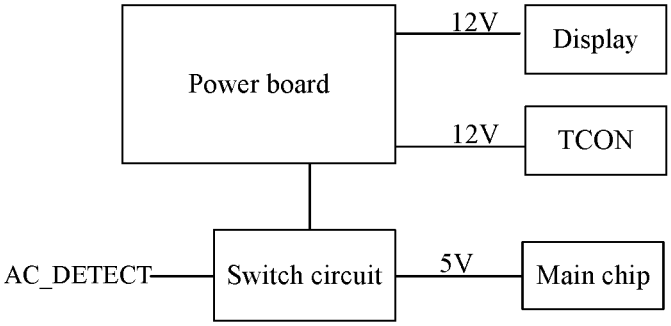
FIG. 4 illustrates a schematic diagram of an AC-powering-off control circuit according to some embodiments of the application.

FIG. 4 illustrates an improved embodiment. The switch circuit is arranged between the power board and the main chip, and controlled by the AC_DETECT signal so that when the OLED display device is AC-powered on (i.e., AC ON), the AC_DETECT signal is at a high level, and the switch circuit is switched off; and when the OLED display device is AC-powered off (i.e., AC OFF), the AC_DETECT signal is at a low level, and the switch circuit is switched on, so all the power supplies in the system are switched off. Accordingly even if the 5 V power supply is output by the power board approximately 20 ms after the OLED display device is AC-powered off (AC_DETECT is pulled down), the 5 V power supply will be switched off by the switch circuit, and thus not transmitted to the main chip. That is, the 5 V power supply to the main chip will drop rapidly, and alike the standby power supply signal 3.3 V will drop rapidly. At this time, when the OLED display device is AC-powered on again, the timing pattern of the main chip is satisfactory, so the display device is able to be started normally.

However, after tests, it is found that the AC_DETECT signal may be pulled down when the OLED display device is AC-powered off, but also may be pulled down when the OLED display device is DC-powered off, so when the OLED display device is DC-powered off (the OLED display device is on standby) in the embodiment above, the switch circuit is also switched on, and the main chip may not be powered with the 5 V power supply, but the main chip is required to operate while the display device is on standby; otherwise, the display device may not be started with a remote controller.

In view of the disclosure above, some embodiments of the application provide an OLED display device.

Figure 5A:
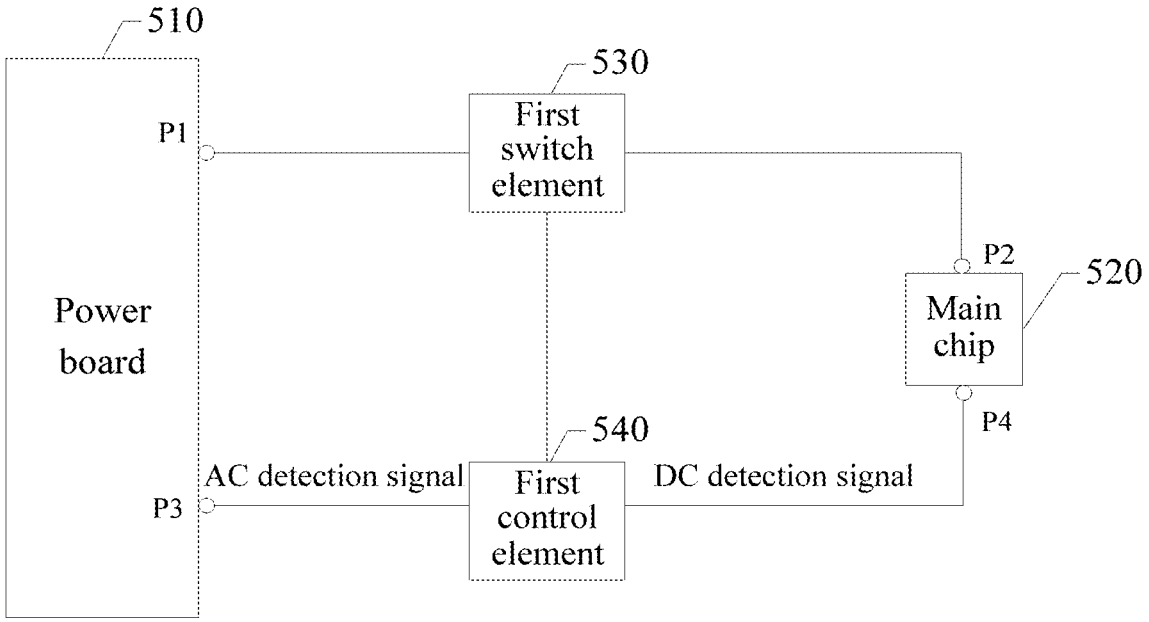
FIG. 5A illustrates a schematic diagram of a power supply circuit according to some embodiments of the application.

As illustrated in FIG. 5A, the OLED display device includes a power board 510, a main chip 520, and a power supply circuit. The power supply circuit includes a first switch element 530 and a first control element 540. The first switch element 530 is electrically connected respectively with a standby voltage terminal P1 of the power board 510, and a standby voltage terminal P2 of the main chip 520, and is configured to control the standby voltage terminal P1 of the power board 510 to connect with or disconnect from the standby voltage terminal P2 of the main chip 520. The first control element 540 is electrically connected respectively with the first switch element 530, a terminal P3 of the power board 510, and a terminal P4 of the main chip 520, and is configured to control the first switch element 530 on or off, in response to an AC detection signal output at the terminal P3 of the power board 510, and a DC detection signal output at the terminal P4 of the primary chip 520. The AC detection signal is a signal for indicating alternating current being switched on or off. The DC detection signal is a signal for indicating direct current being switched on or off. The AC detection signal is an AC_DETECT signal output at the terminal P3 of the power board 510, and the DC detection signal is a DC_DETECT signal output at a GPIO port of the main chip 520.

In some embodiments, the AC detection signal is pulled down upon reception of the AC OFF signal, but in order to enable the OLED panel to be further powered for a period of time after it is powered off, the electrolytic capacitors added to the power board may be discharged to maintain the standby power voltage, so the DC detection signal is still at a high level. There is such a control logic of the OLED display device that when the AC detection signal is at a low level, and the DC detection signal is at a high level, the first switch circuit is controlled to cut off to disconnect the standby voltage terminal of the power board from the standby voltage terminal of the main chip. Accordingly in the OLED display device and the method for controlling the OLED display device according to the embodiments of the application, such a problem may be addressed that when the OLED display device is AC-powered off, the power supply to the main chip will not drop rapidly so that the OLED display device will not be started normally when it is AC-powered on again.

In some embodiments of the application, when the OLED display device is AC-powered off, the AC detection signal is changed from a high level to a low level, and the first control element 540 controls the first switch element 530 to cut off to thereby disconnect the standby voltage terminal P1 of the power board 510 from the standby voltage terminal P2 of the main chip 520 so as to stop the standby voltage from being supplied to the main chip 520, so that the 5 V standby voltage to the main chip may be switched off rapidly when the OLED display device is AC-powered off. Since the 5 V standby voltage may be switched off rapidly when the OLED display device is AC-powered off, the OLED display device may be started normally when it is AC-powered on.

In some embodiments of the application, when the OLED display device is DC-powered off, firstly the DC detection signal is changed from a high level to a low level, and the first control element 540 controls the first switch element 530 to maintain switched on, and then the AC detection signal is changed from a high level to a low level. Since the DC detection signal jumps earlier than the AC detection signal, the first switch element 530 is controlled when the DC detection signal is changed from a high level to a low level, so that the OLED display device may become on standby normally when it is DC-powered off.

If the first control element 540 receives a first input signal that alternating current is switched off by the power board 510 and a third input signal that the main chip 520 is DC-powered on, a second control signal will be output. The second control signal is a signal for controlling the first switch element 530 to power off the main chip 520, so the first switch element 530 controls the main chip 520 to power off, upon reception of the second control signal.

In order to address the problem that the display device is woken up falsely when it is AC-powered off after its DC standby so that it may not be really woken up in some period of time, in some embodiments of the application further to the respective embodiments of the application above, the main chip further includes a system kernel element and a standby waking element, both of which are in connection with each other.

The system kernel element is configured to receive a first wake up signal sent from the standby waking element, execute startup program, and send first confirmation information to the standby waking element when a preset component of the startup program is executed.

The standby waking element is configured to: upon reception of a standby waking signal, send the first wake up signal to the system kernel element, start a timer, determine whether the first confirmation information sent from the system kernel element is received within the timing length set by the timer, and if the first confirmation information sent from the system kernel element is not received within the time length of the timer, output a third input signal that the main chip is DC-powered on.

In some embodiments, the main chip includes the system kernel element and the standby waking element, both of which are in connection with each other. The system kernel element includes an ARM chip configured to keep the system in operation after the OLED display device is started, and the standby waking element includes a T8032 chip configured to wake up the ARM chip in response to a waking instruction on standby.

In order to address the problem above that when the started OLED display device is AC-powered off, the display device may not be powered on again and woken up while the electrolytic capacitors are being discharged, the first control element and the first switch element are arranged in the embodiments of the application. However if the OLED display device is AC-powered off after it enters into DC standby, it will be woken falsely. While the OLED display device is on normal DC standby, both the power board and the main chip are powered off, and at this time, it is impossible for the first control element to receive both the first input signal that alternating current is switched off by the power board, and the third input signal that the main chip is DC-powered on, so the main chip may not be controlled to power off, and the T8032 chip arranged in the main chip to wake up the display device is still powered normally.

Figure 5B:
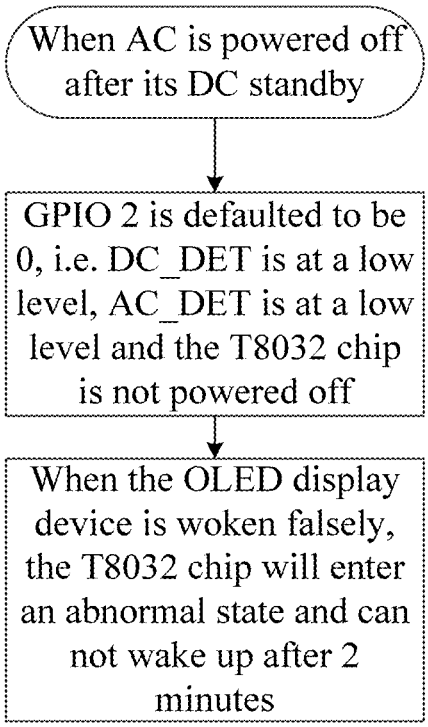
FIG. 5B illustrates a schematic diagram of a process according to some embodiments of the application where an OLED display device is woken up falsely when it is AC-powered off after its DC standby.

If the OLED display device is AC-powered off, and someone accidently touches a Wakeup button on the remote controller of the OLED display device by mistake, the electrolytic capacitors will be discharged to power on the T8032 chip and the ARM chip as well, so that the OLED display device is waken up. However, since the ARM chip is powered off more quickly than the T8032 chip, the ARM chip is disabled when it is powered down, and the T8032 chip is still powered on and determines that the OLED display device is woken up, so if the OLED display device is AC-powered off at this time, it will not be woken again. FIG. 5B illustrates a particular process in which the OLED display device is woken falsely when it is AC-powered off after its DC standby.

When the OLED display device enters into DC standby, the AC power-on detection signal, AC_DET, of the power source is pulled down to a low level, and the DC power-on detection signal, DC_DET, is also at a low level by default, so the T8032 chip is powered normally. If the OLED display device is AC-powered off at this time, the AC_DET and the DC_DET will be still at a low level, that is, the first control element will receive input signals of DC-powered off and AC-powered off, so that the T8032 chip is still powered on in response to the output of the first control element. If the OLED display device is being woken, it will have been woken falsely, that is, no kernel has been loaded into the ARM chip, and since the ARM chip is not powered sufficiently, it will be disabled directly, but the T8032 chip will be still powered for a period of time. If the OLED display device is AC-powered on again, the T8032 chip determines that the ARM chip has been woken up and will not wake up the ARM chip any more.

In view of the disclosure above, in the embodiments of the application, the startup program is newly burned into the main chip to thereby address the above problem.

When a user presses down a standby button on a remote controller, a standby waking signal will be sent to the OLED display device via the remote controller. The standby waking element receives the standby waking signal, and wakes up the OLED display device by sending the first wake up signal to the system kernel element of the main chip.

The system kernel element starts to execute the startup program, upon reception of the first wake up signal. Normally the system kernel element sends the first confirmation information to the standby waking element when the preset component of the startup program is executed, to indicate that the system kernel element has been started normally at present, where the preset component is a core component, i.e., a kernel component, of the startup program, so that the OLED display device may be started normally when that component of the startup is executed.

The standby waking element starts the timer while sending the first wake up signal, and determines whether the first confirmation information is received in the timing length set by the timer. If so, the standby waking element will stop responding to the standby waking signal, otherwise, it will indicate that the system core element is currently abnormal, that is, the OLED display device is woken falsely: the system core element is disabled directly because it is not powered sufficiently. In order to avoid the display device from failing to be woken when it is AC-powered on again while the standby waking element is being powered, the standby waking element shall output at this time the third input signal that the main chip is DC-powered on, and control the standby waking element in the main chip to power off the display device directly, through the first control element and the first switch element, so that the system of the display device is reset, and may be started normally again.

Figure 5C:
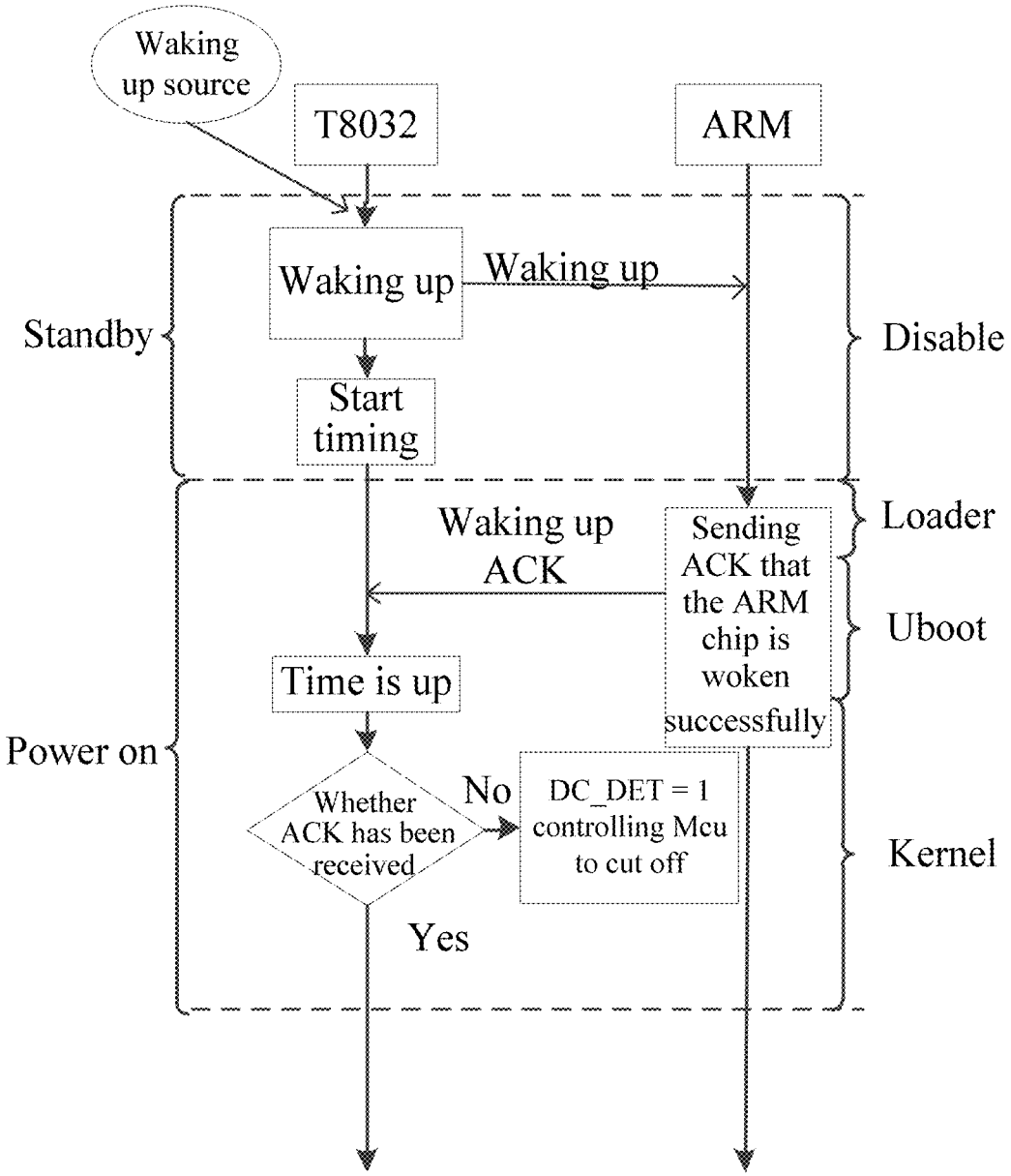
FIG. 5C illustrates an interaction process between a T8032 chip and an ARM chip to address the problem of false waking-up according to some embodiments of the application.

In order to address the state of being woken falsely, an interaction process between the T8032 chip of the standby waking element and the ARM chip of the system core network in a startup process may be performed as illustrated in FIG. 5C.

In a first operation, while the OLED display device is on standby, the T8032 chip detects whether the standby waking signal is received, and upon reception of the standby waking signal, the T8032 chip wakes up the ARM chip by sending the first wake up signal thereto, and also gets the timer started.

The ARM chip starts to execute the startup program, upon reception of the first wake up signal, and sends ACK that the ARM chip is woken successfully, i.e., the first confirmation information, to the T8032 chip when the kernel component of the startup program is executed.

In a second operation, the T8032 chip determines whether the first confirmation information sent from the ARM chip is received within the time length set by the timer.

In a third operation, if no first confirmation information is received, the OLED display device will not be started normally, that is, woken falsely, so the T8032 chip outputs the third input signal that the OLED display device is DC-powered on, e.g., DC_DET=1, which may be used to control power off through the first control element and the first switch element.

If the first confirmation information is received, the OLED display device will be started, so the T8032 chip will not respond to the standby waking signal any more.

In some embodiments of the application, the system core network sends the first confirmation information to the standby waking element when the preset component of the startup program is executed, to thereby determine that the OLED display device has been woken, so as to address the problem if the OLED display device is woken falsely after the OLED display device on standby is AC-powered on, it will not be really woken in some period of time.

Figure 6A:
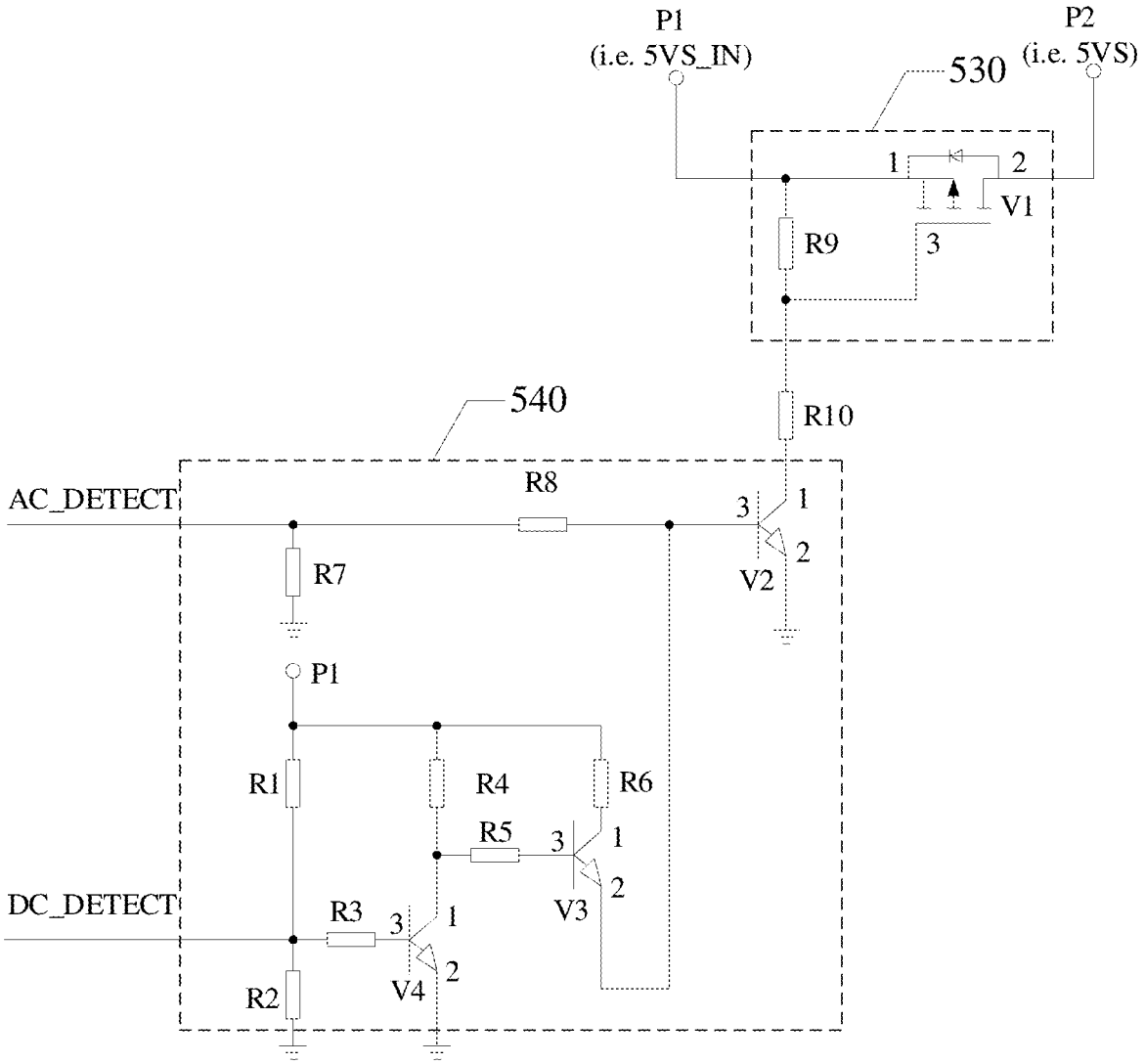
FIG. 6A illustrates a schematic diagram of a power supply circuit according to some other embodiments of the application.

FIG. 6A illustrates a schematic diagram of the power supply circuit according to some other embodiments of the application. In the embodiments as illustrated in FIG. 6A, the first switch element 530 includes a first transistor V1, an optional MOS transistor, a triode, etc., and the first control element 540 includes a second transistor V2, a third transistor V3, and a fourth transistor V4.

It shall be noted that if the second transistor V2 is switched on, the first transistor V1 will be switched on, or if the second transistor V2 is switched off, the first transistor V1 will be switched off. The second transistor V2 is controlled by both the level of AC_DETECT, and the level at a second terminal of the third transistor V3, where the second transistor V2 is switched on when at least one of these two levels is a high level, and the second transistor V2 is switched off when both of these two levels are a low level.

In some embodiments of the application, the first transistor V1 has a control terminal 3 electrically in connection with a first terminal 1 of the second transistor V2, a first terminal 1 electrically in connection with the standby voltage terminal P1, i.e., 5VS_IN, of the power board 510, and a second terminal 2 electrically in connection with the standby voltage terminal P2, i.e., 5VS, of the main chip 520. Optionally, the second terminal 2 of the first transistor V1 may be in connection with a standby voltage terminal of the main board (not illustrated) as well. When the first transistor V1 is switched on, the standby voltage terminal P1 of the power board 510 is controlled to connect with the standby voltage terminal P2 of the main chip. When the first transistor V1 is switched off, the standby voltage terminal P1 of the power board 510 is controlled to disconnect from the standby voltage terminal P2 of the main chip. When the standby voltage terminal P1 of the power board 510 is in connection with the standby voltage terminal P2 of the main chip, the main chip 520 may be powered with the standby voltage of the power board 510, i.e., the 5 V voltage; and the standby voltage terminal P1 of the power board 510 is disconnected from the standby voltage terminal P2 of the main chip, the main chip 520 is stopped from being powered with the standby voltage of the power board 510 so that the 5 V standby voltage to the main chip 520 may be switched off rapidly.

In some embodiments of the application, the second transistor V2 has a control terminal 3, a second terminal 2, and the first terminal 1. The control terminal 3 may electrically connect respectively with a second terminal 2 of the third transistor V3, and the terminal P3 of the power board 510 (as illustrated in FIG. 5A). The second terminal 2 may connect to ground. The control terminal 3 of the second transistor V2 may receive the AC detection signal, i.e., the AC_DETECT signal. The third transistor V3 has a control terminal 3 electrically in connection with a first terminal 1 of the fourth transistor V4, and a first terminal 1 electrically in connection with the standby voltage terminal P1 of the power board 510. The fourth transistor V4 has a control terminal 3 electrically in connection with the terminal P4 of the power board 510 (as illustrated in FIG. 5A), and a second terminal 2 grounded, and the control terminal 3 of the fourth transistor V4 receives the DC detection signal, i.e., the DC_DETECT signal.

In some embodiments of the application, when it is detected that the OLED display device is AC-powered off, the AC_DETECT signal is pulled from a high level down to a low level, but at this time, the electrolytic capacitors are discharged so that the standby voltage 5VS_IN is not switched off, that is, the OLED display device is not DC-powered off, and DC_DETECT remains at a high level, so the fourth transistor V4 is switched on, and the third transistor V3 is switched off. Since the AC_DETECT signal is at a low level, and the third transistor V3 is switched off, so that the voltage at the second terminal thereof is low, so the voltage at the base of the second transistor V2 is at a low level, that is, the second transistor V2 is switched off. Since the second transistor V2 is switched off, and the first transistor V1 is switched off, the standby voltage 5 V of the main chip SoC (System on Chip) may be switched off rapidly. When the OLED display device is AC-powered on again, the standby power supply signal is at a low level, and the main chip may operate in the timing pattern as illustrated in FIG. 1A, so the display device may be started normally.

Figure 11:
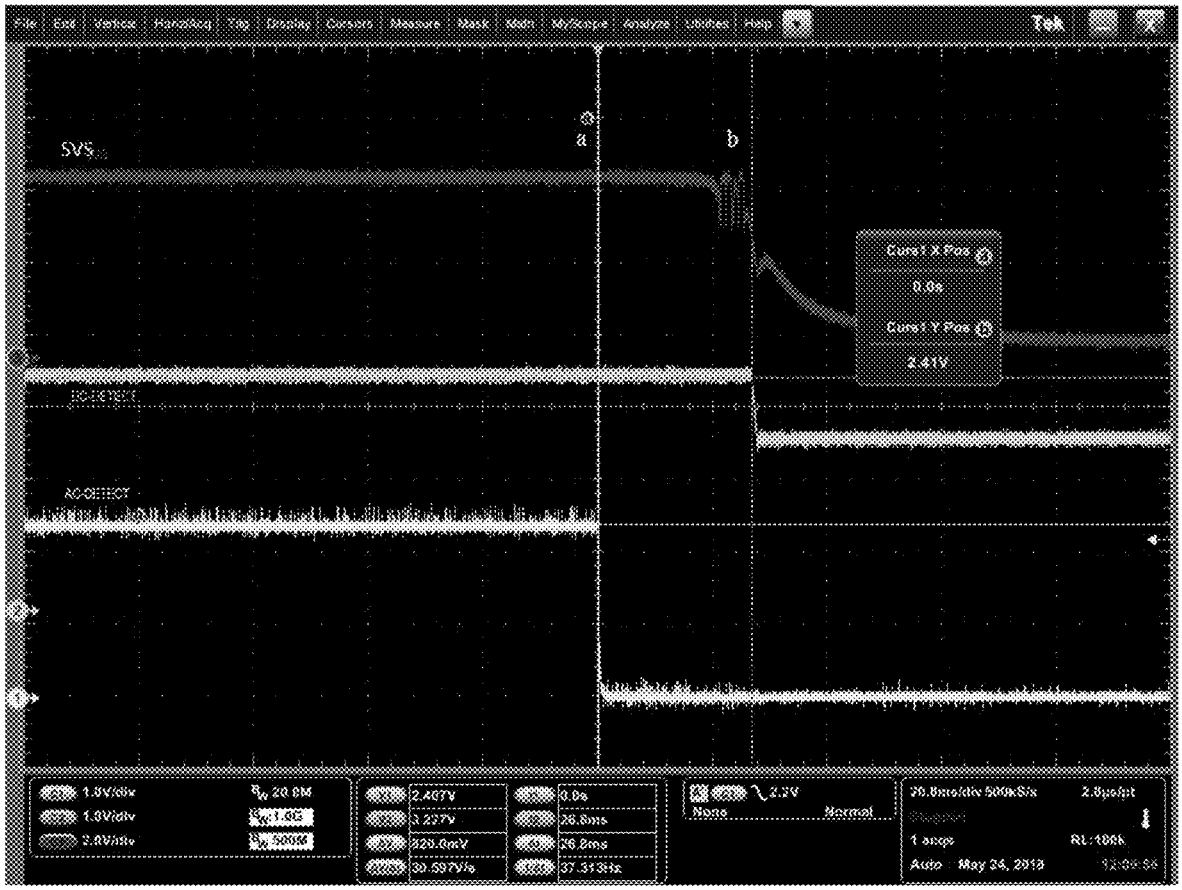
FIG. 11 illustrates a schematic timing diagram of AC-powering off the OLED display device according to some embodiments of the application.

FIG. 11 illustrates a timing diagram of AC-powering off the OLED display device according to some embodiments of the application. As illustrated in FIG. 11, while the OLED display device is switched on, upon reception of the signal which indicates that the OLED display device is AC-powered off, i.e., at the instance of time denoted by the vertical line a, the AC_DETECT signal is pulled from a high level to a low level, and at this time, the first transistor V1, i.e., the MOS transistor V1, is switched off, and the standby voltage 5VS is switched off rapidly; and then the DC_DETECT signal is changed from a high level to a low level, for example, after 26.8 ms, i.e., at the instance of time denoted by the vertical line b.

In some embodiments of the application, when it is detected that the OLED display device is AC-powered on, the AC_DETECT signal is changed to a high level so that the second transistor V2 is switched on, and the first transistor V1 is switched on, so the standby voltage 5 V is switched on; and since the standby power supply signal is at a low level when the OLED display device is AC-powered off, the main chip may operate in the timing pattern as illustrated in FIG. 1A, so the OLED display device may be started normally.

Figure 12:
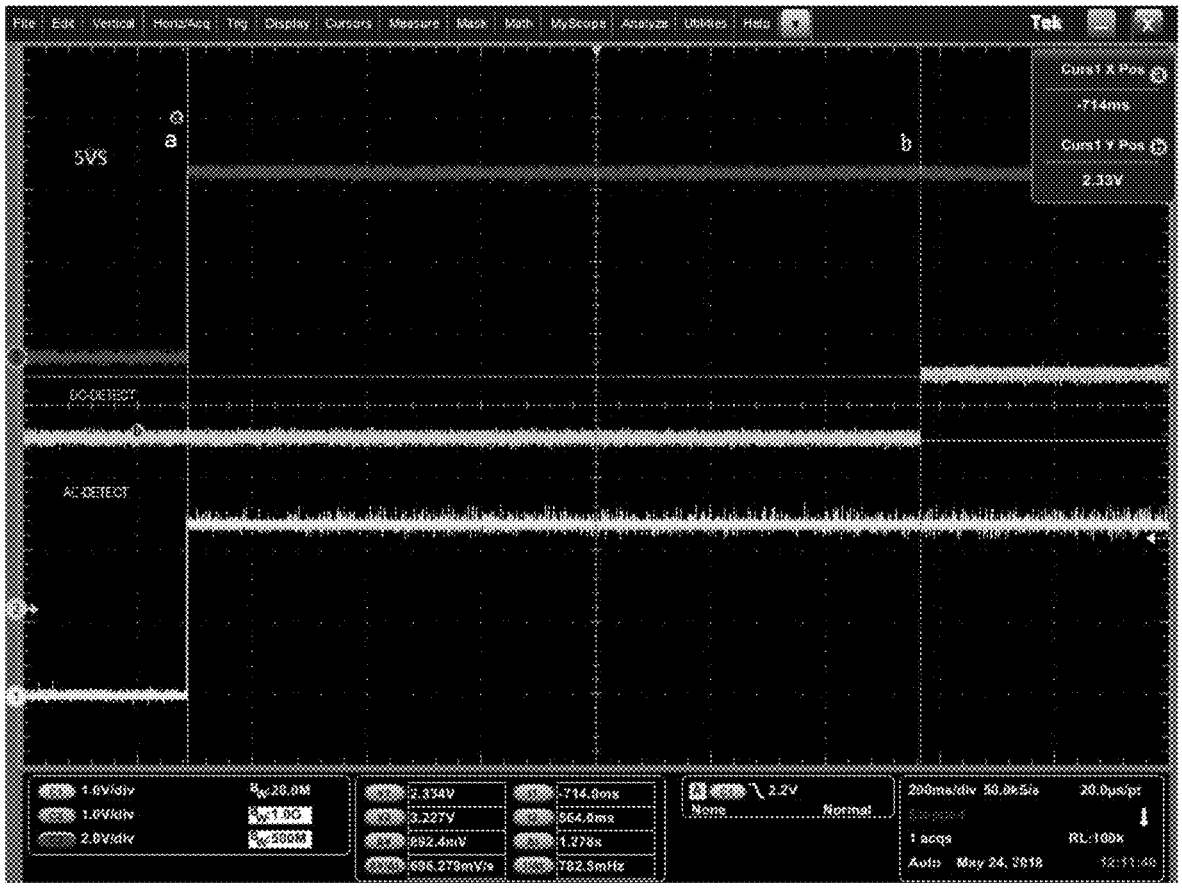
FIG. 12 illustrates a schematic timing diagram of AC-powering on the OLED display device according to some embodiments of the application.

FIG. 12 illustrates a schematic timing diagram of AC-powering on the OLED display device according to some embodiments of the application. As illustrated in FIG. 12, while the OLED display device is switched off, upon reception of the signal which indicates that the OLED display device is AC-powered on, i.e., at the instance of time denoted by the vertical line a, the AC_DETECT signal is pulled from a low level up to a high level, and as described above, as long as the level of AC_DETECT, and the level at the second terminal of the third transistor V3 is high, the second transistor V2 is switched on, the MOS transistor V1 is switched on, and the standby voltage 5 V is switched on; and then the DC_DETECT signal is pulled from a low level up to a high level at the instance of time denoted by the vertical line b.

In some embodiments of the application, when the OLED display device receives the standby signal while it is DC-powered off, firstly the DC_DETECT signal jumps from a high level to a low level, and then the AC_DETECT signal jumps from a high level to a low level. When DC_DETECT jumps to a low level, the fourth transistor V4 is switched off, the third transistor V3 is switched on, and the voltage at the base of the second transistor V2 is at a high level; and since AC_DETECT is at a high level, and the voltage at the base of the second transistor V2 is at a high level, the second transistor V2 is switched on (as described above, so a repeated description thereof will be omitted here), and the first transistor V1 is switched on, so the standby voltage 5 V may remain switched on.

When AC_DETECT also jumps to a low level, DC_DETECT is still at a low level, so the fourth transistor V4 is switched off, the third transistor V3 is switched on, and the voltage at the base of the second transistor V2 is at a high level, so the second transistor V2 is still switched on (as described above, so a repeated description thereof will be omitted here), and the first transistor V1 is switched on, so the standby voltage 5 V may remain switched on.

Figure 13:
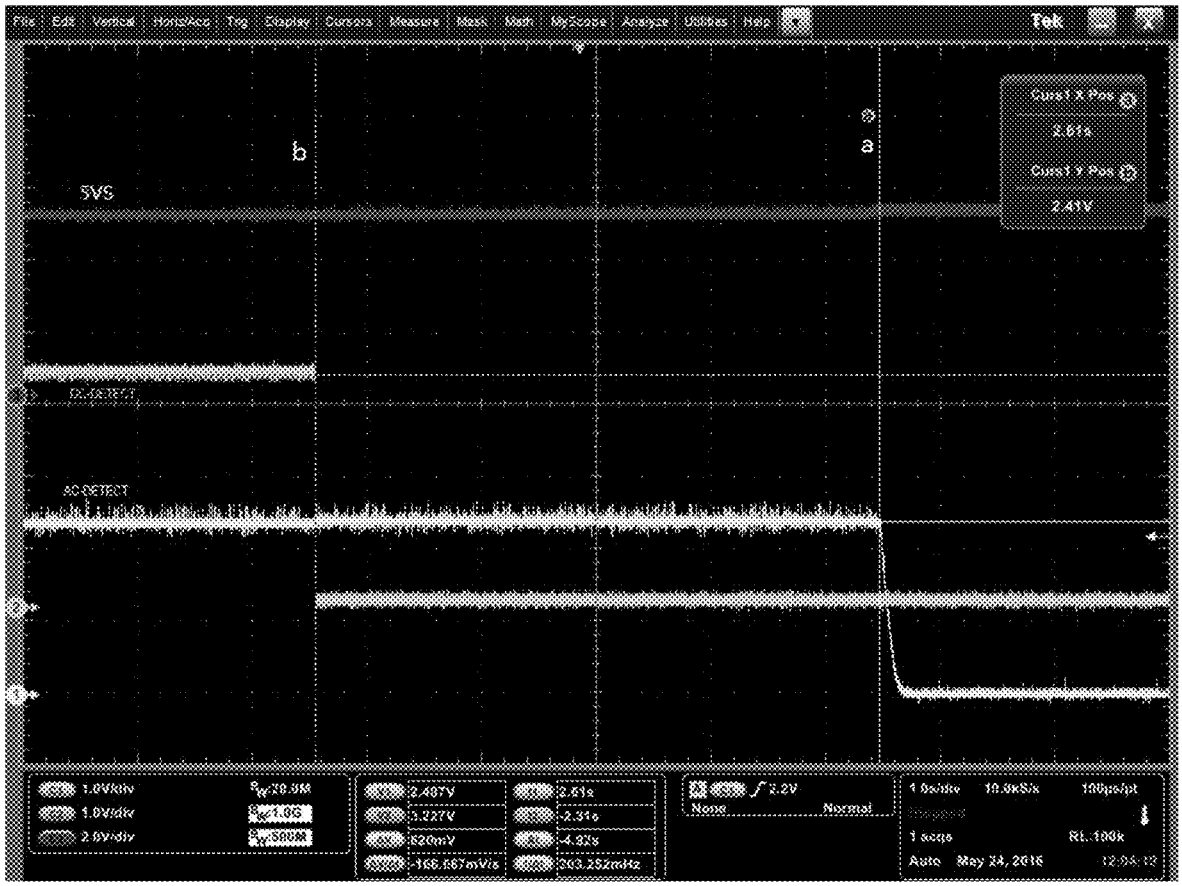
FIG. 13 illustrates a schematic timing diagram of DC-powering off the OLED display device according to some embodiments of the application.

FIG. 13 illustrates a schematic timing diagram of DC-powering off the OLED display device according to some embodiments of the application. As illustrated in FIG. 13, while the OLED display device is switched on, upon reception of the signal for indicating the OLED display device being DC-powered off, i.e., at the instance of time denoted by the vertical line b, the DC_DETECT signal is pulled from a high level down to a low level, and at this time, the AC_DETECT signal is still at a high level, and both of voltage signals to the base of the second transistor V2 from two branches are at a high level, so the second transistor V2 is switched on, the MOS transistor V1 remains switched on, and the standby voltage 5 V remains switched on; and then the AC_DETECT signal is pulled from a high level down to a low level at the instance of time denoted by the vertical line a, but the DC_DETECT signal is at a low level, and the branch thereof provides the base of the second transistor V2 with a high level, so the second transistor is still switched on, the MOS transistor V1 remains switched on, and the standby voltage 5 V remains switched on.

In some embodiments of the application, when the OLED display device is DC-powered on, the AC_DETECT signal firstly jumps from a low level to a high level, and then the DC_DETECT signal jumps from a low level to a high level. When the AC_DETECT signal is at a high level, the first transistor V1 is switched on (as described above, so a repeated description thereof is omitted here), so the standby voltage 5 V may remain switched on.

Figure 14:
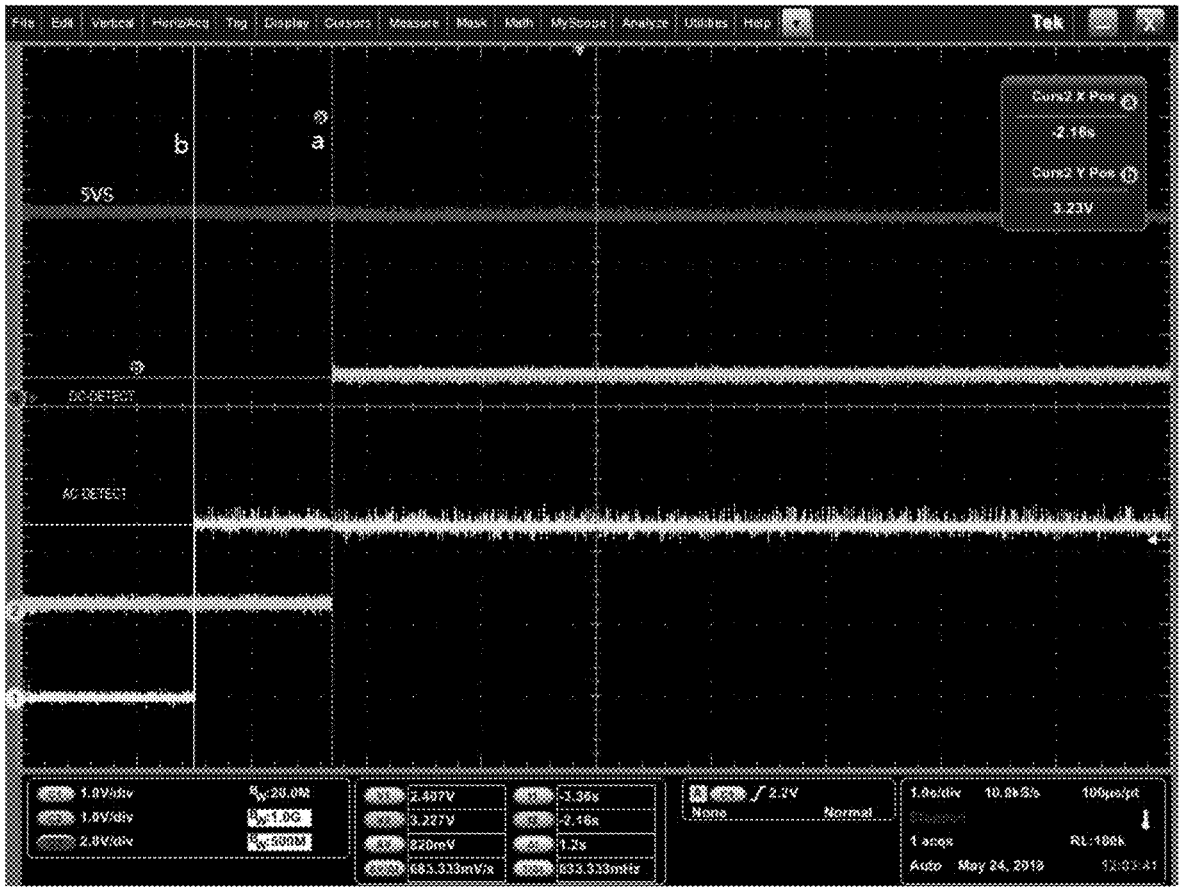
FIG. 14 illustrates a schematic timing diagram of DC-powering on the OLED display device according to some embodiments of the application.

FIG. 14 illustrates a schematic timing diagram of DC-powering on the OLED display device according to some embodiments of the application. As illustrated in FIG. 14, when the OLED display device is on standby, upon reception of the signal for indicating the OLED display device being DC-powered on, i.e., at the instance of time denoted by the vertical line b, firstly the AC_DETECT signal is pulled from a low level to a high level, and then at the instance of time denoted by the vertical line a, the DC_DETECT signal is pulled up from a low level to a high level, and at this time, the MOS transistor V1 remains switched on, and the standby voltage 5 V remains switched on.

It shall be noted that although FIG. 6A illustrates the first transistor V1 which is a P-type MOS transistor, and the second transistor V2, the third transistor V3, and the fourth transistor V4, all of which are NPN-type triodes, where the first terminals of the second transistor V2, the third transistor V3, and the fourth transistor V4 are collectors, the second terminals thereof are emitters, and the control terminals thereof are bases, those skilled in the art shall appreciate that the first transistor, the second transistor, the third transistor, and the fourth transistor may alternatively be transistors in another appropriate form. For example, the first transistor V1 may alternatively be an N-type MOS transistor, and one or more of the second transistor V2, the third transistor V3, and the fourth transistor V4 may alternatively be a PNP-type triode(s).

In some embodiments of the application, the first terminal of the first transistor V1 is a source, the second terminal thereof is a drain, and the control terminal thereof is a gate, but the embodiments of the application will not be limited thereto. For example, the first terminal of the transistor V1 may alternatively be a drain, and the second terminal thereof may alternatively be a source, without departing from the claimed scope of the application.

Figure 6B:
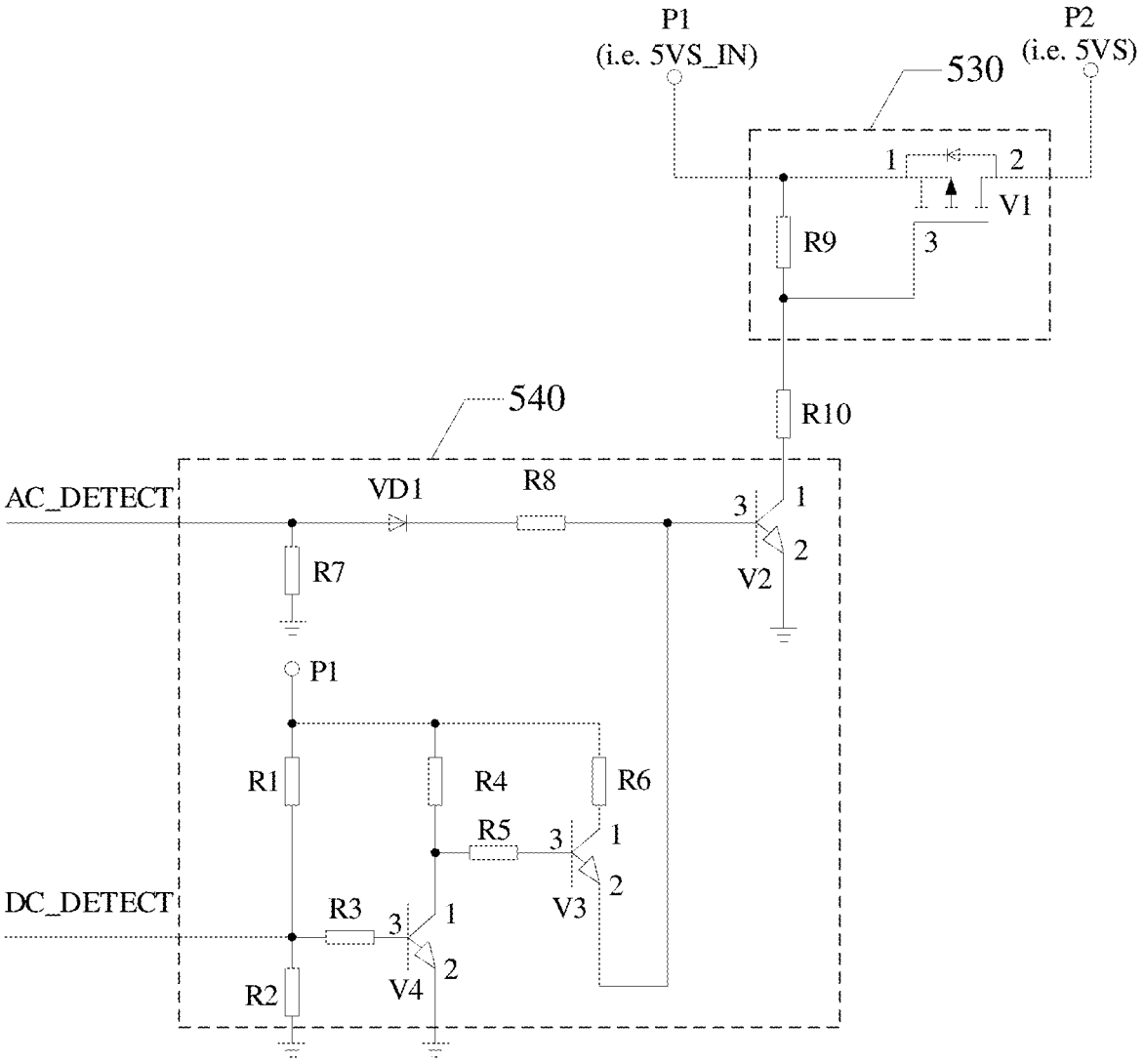
FIG. 6B illustrates a schematic diagram of a power supply circuit according to some still other embodiments of the application.

Moreover in some embodiments of the application, as illustrated in FIG. 6B, the first control element 540 may further optionally include a diode VD1 with a first terminal configured to receive the AC power-on detection signal AC_DETECT, and a second terminal electrically in connection with the control terminal of the second transistor V2. While the OLED display device is DC-powered off, the AC_DETECT signal is at a low level, and the control terminal 3 of the second transistor V2 is at a high level, so the uni-directionally conducting diode VD1 may prevent the voltage from being poured back to the AC power-on detection signal, AC_DETECT, when the OLED display device is DC-powered off.

It shall be noted that the resistances of resistors R1 to R10 will not be limited to any particular resistances in the embodiments of the application, but may alternatively be other resistances in another embodiment of the application.

Figure 7:
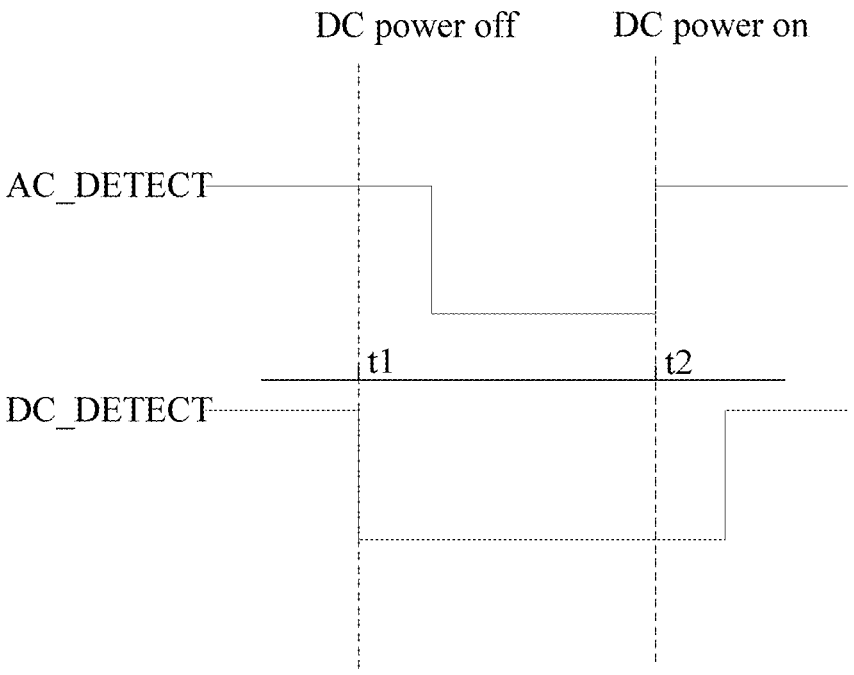
FIG. 7 illustrates a schematic timing diagram of an AC control signal and a direct current (DC) control signal for DC-powering-on or DC-powering-off the OLED display device according to some embodiments of the application.

FIG. 7 illustrates a schematic timing diagram of an AC control signal and a DC control signal for DC-powering-on or DC-powering-off the OLED display device according to some embodiments of the application.

As illustrated in FIG. 7, in order to maintain the standby voltage when the OLED display device is AC-powered off, another control signal, e.g., DC_DETECT, is required to keep the first switch element 530 switched on even when the OLED display device is DC-powered off. That is, when the OLED display device is DC-powered off, the DC_DETECT control signal will jump earlier than AC_DETECT to thereby keep the first switch element 530 switched on. In this way, even if the OLED display device is DC-powered off, the first switch element 530 may remain switched on so that the OLED display device may be started normally.

In FIG. 7, when the OLED display device is DC-powered off, i.e., at the instance of time t1, the OLED display device receives the standby signal, so firstly the DC_DETECT signal jumps from a high level to a low level, and then the AC_DETECT signal jumps from a high level to a low level. With reference to FIG. 6A and FIG. 6B, when DC_DETECT jumps to a low level, the triode V4 is switched off, the triode V3 is switched on, the voltage at the base of the triode V2 is high, and AC_DETECT is still at a high level, so at this time (the diode VD1 is switched on as illustrated in FIG. 6B alone), the voltage at the base of the triode V2 is still high, the triode V2 is switched on, and the MOS transistor V1 is switched on, so the standby voltage V5 may remain switched on.

When AC_DETECT also jumps to a low level, DC_DETECT is at a low level, the triode V4 is switched off, the triode V3 is switched on, the voltage at the base of the triode V2 is still high, the triode V2 is switched on, and the MOS transistor V1 is switched on, so the standby voltage V5 may remain switched on.

In FIG. 7, when the OLED display device is DC-powered on, i.e., at the instance of time t2, the AC_DETECT signal firstly jumps from a low level to a high level, and then the DC_DETECT signal jumps from a low level to a high level. When the AC_DETECT signal is at a high level, the MOS transistor V1 is switched on, so the standby voltage V5 may remain switched on.

In some embodiments of the application, a logic relationship between the AC detection signal, i.e., AC_DETECT, the DC detection signal, i.e., DC_DETECT, the first transistor, and the standby voltage 5 V is as depicted in Table 1 below.

TABLE 1

A logic relationship between AC_DETECT, DC_DETECT, the first transistor, and 5VS

| AC_DETECT | DC_DETECT | The state of the first transistor | 5VS |
|---|---|---|---|
| H | H | ON | ON |
| H | L | ON | ON |
| L | H | OFF | OFF |
| L | L | ON | ON |

In Table 1, when both the AC_DETECT signal and the DC_DETECT signal are at a high level, the MOS transistor is switched on, and the standby voltage 5 V remains switched on; when the AC_DETECT signal is at a high level, and the DC_DETECT signal is at a low level, the MOS transistor V1 is switched on, and the standby voltage 5 V remains switched on; when the AC_DETECT signal is at a low level, and the DC_DETECT signal is at a high level, the MOS transistor V1 is switched off, and the standby voltage 5 V remains switched off; and when both the AC_DETECT signal and the DC_DETECT signal are at a low level, the MOS transistor V1 is switched on, and the standby voltage 5 V remains switched on.

In order to enable the first control element to output the second control signal to power off the main chip, in some embodiments further to the respective embodiments of the application, the analog circuit above may be replaced with a digital circuit.

The first control element includes a logic NOT gate and a logic AND NOT gate.

The logic NOT gate has an input terminal in connection with the power board, and an output terminal in connection with an input terminal of the logic AND NOT gate.

The logic AND NOT gate has the other input terminal in connection with the main chip, and an output terminal in connection with the first switch element.

In order to enable the main chip to power off in response to the second control signal, the first switch element includes a first switch.

The first switch is connected respectively with the output terminal of the logic AND NOT gate, the power board, and the standby waking element.

In order to address the problem that when the started OLED display device is AC-powered off, the OLED display device may not be powered on again and woken up while the electrolytic capacitors are being discharged, the first control element includes a logic NOT gate and a logic AND NOT gate, where the logic NOT gate has an input terminal in connection with the power board, and an output terminal in connection with an input terminal of the AND NOT gate, and the AND NOT gate, has the other input terminal in connection with the main chip, and an output terminal in connection with the first switch element.

The first switch element includes the first switch. In order to address the problem that the OLED display device may not be woken up because the main chip may not be powered off in a preset timing manner while the electrolytic capacitors are being discharged, the first switch shall be controlled to open in this state to thereby power off T8032 of the main chip.

In some embodiments, the first control element and the first switch element in the embodiments of the application operate according to the following principles.

While the OLED display device is operating normally, both the power board and the main chip are powered on. That is, both the AC power-on detection signal, AC_DET, and the DC power-on detection signal, DC_DET, of the power board are at a high level. That is, such one of the input terminals of the logic AND NOT gate that is in connection with the logic NOT gate is inverted once by the logic NOT gate so that a low level is input to the input terminal, and a high level is input to the other input terminal. At this time, a high level is output according to the control logic of the logic AND NOT gate, and since the main chip is not required to power off at this time, the first switch of the first switch element shall be closed, there is such a control logic of the first switch that it is opened at a low level, and closed at a high level. If the Standby button is pressed on for standby, then both AC_DET and DC_DET will be at a low level so that a high level is output according to the control logic of the logic NOT gate and the logic AND NOT gate, and at this time, the first switch is closed so that the OLED display device on standby may be woken.

If the OLED display device is AC-powered off suddenly after it is started, AC_DET will be at a low level, and since the electrolytic capacitors are discharged, DC_DET is at a high level. At this time, in order to avoid the display device from failing to be woken while the electrolytic capacitors are being discharged, a low level is output through the logic NOT gate and the logic AND NOT gate, so that the first switch is opened, that is, the main chip is powered off. Particularly the standby waking element T8032 in the main chip is powered off so that the OLED display device is reset and thus may be started normally. While the system of the OLED display device is being upgraded or reset to its factory setting, it is not AC-powered off at this time, that is, AC_DET is at a high level, but the main chip is operating abnormally, and DC_DET is at a low level, so a high level is output through the logic NOT gate and the logic AND NOT gate to power the main chip so that the system of the main chip may be upgraded or reset to its factory setting. Particularly the first control element and the first switch element may control T8032 to power off as depicted in Table 2.

TABLE 2

| A logic relationship between AC_DETECT (AC_DET), DC_DETECT (DC_DET), the switch, and T8032 power | | | |
|---|---|---|---|
| Input 1(AC_DET) | Input 2(DC_DET) | The state of the switch | T8032 powered on or off |
| L | L | OFF | Powdered on |
| L | H | ON | Powdered off |
| H | L | OFF | Powdered on |
| H | H | OFF | Powdered on |

Here H represents a high level, and L represents a low level.

In the embodiments of the application, a logic NOT gate and a logic AND NOT gate are arranged in the first control element to output the second control signal for controlling the main chip to power off, and the switch is arranged in the first switch element to control the main chip to power up and power off.

Figure 8:
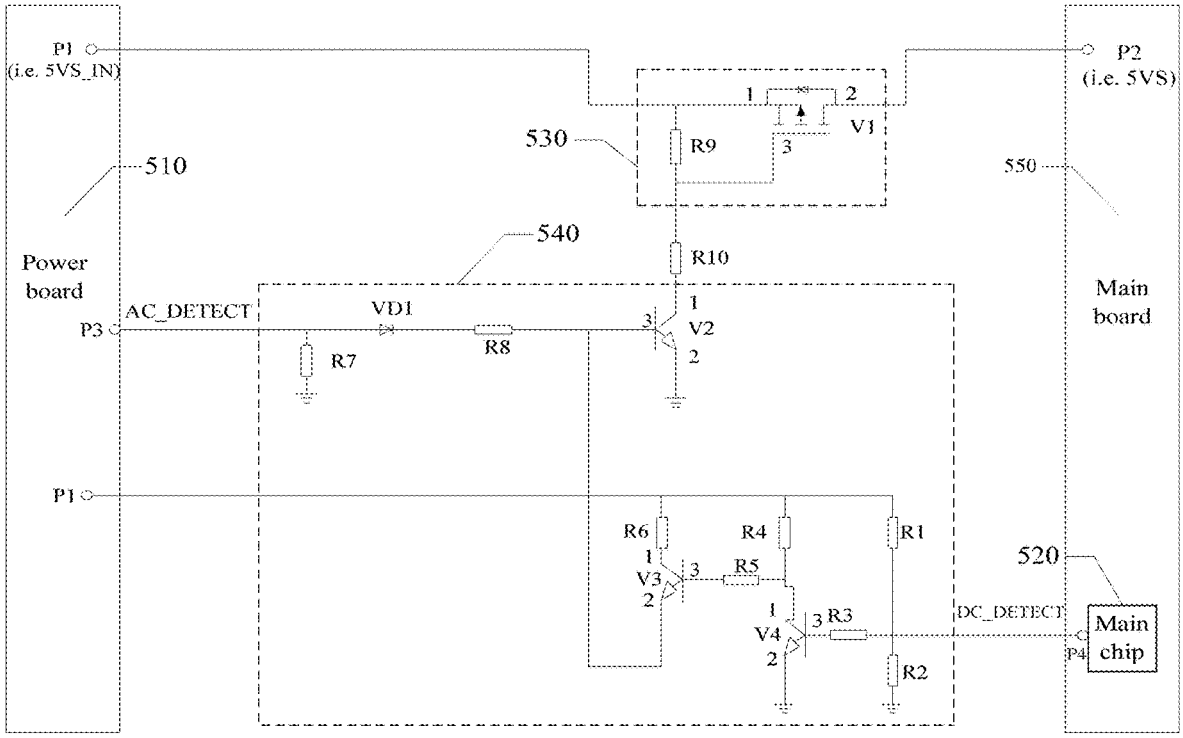
FIG. 8 illustrates a schematic diagram of an OLED display device according to some still other embodiments of the application.

FIG. 8 illustrates a schematic diagram of an OLED display device according to some still other embodiments of the application. As illustrated in FIG. 8, the OLED display device includes a power board 510, a main chip 520, a main board 550, and a power supply circuit. The power supply circuit includes a first switch element 530 and a first control element 540. The first switch element 530 is electrically in connection with the standby voltage terminal P1 of the power board 510, and the standby voltage terminal P2 of the main board 550, and is configured to control the standby voltage terminal P1 of the power board 510 to connect with or disconnect from the standby voltage terminal P2 of the main board 550. The first control element 540 is electrically connected respectively with the first switch element 530, and is configured to control the first switch element 530 to turn on or cut off, in response to an AC detection signal AC_DETECT output at a terminal P3 of the power board 510, and a DC detection signal DC_DETECT output at a terminal P4 of the primary chip 520. The AC detection signal indicates whether a signal that the OLED display device is AC-powered on or off is received. A particular structure of the power supply circuit is substantially the same as the power supply circuit as illustrated in FIG. 6B, so a repeated description thereof will be omitted here.

An OLED display device has unapproachable core indexes of color rendering, contrast, a response speed, an angle of view, etc., in the field of display devices with a large panel, so the OLED display device has been advancing rapidly. However an OLED panel is powered in such a way that a panel logic control element is separate from a panel display driving element, where the panel logic control element is responsible for parsing a video signal transmitted by a main chip, and controlling the panel display driving element to display an image, and after the panel display driving element is powered off, it is discharged slowly due to the characteristic of the OLED panel, so if both of them are controlled to power off, then such a situation will occur that the panel logic control element has been powered off, and the panel display driving element has not been powered off, thus resulting in an afterimage on the OLED panel; and since the OLED panel is out of control, there is a probability that the panel is burned. In the related art, in order to prevent an afterimage from occurring, electrolytic capacitors are commonly introduced to the power source end, but the electrolytic capacitors may only keep an ARM chip powered for a very period of time, so the ARM chip may not instruct the panel display driving element to discharge, but may only instruct the panel display driving element to discharge rapidly, through the power source so that the panel may be discharged in a satisfactory timing pattern when the OLED display device is AC-powered off, to thereby prevent an afterimage from occurring.

When the OLED display device is AC-powered off, the panel display driving element may be firstly discharged to thereby prevent an afterimage from occurring, but the panel display driving element shall also be discharged in a number of scenarios where the display device is upgraded, reset to its factory setting, recovered from a failure, etc., and at this time, the system will instruct the panel display driving element to discharge; and since the OLED display device is not AC-powered off, the power source does not discharge the panel display driving element, thus disordering the timing for discharging the panel. Accordingly, the panel display driving element may not be instructed to discharge rapidly, while the OLED display device is AC-powered off in a number of scenarios, so an afterimage may not be prevented from occurring.

Figure 9A:
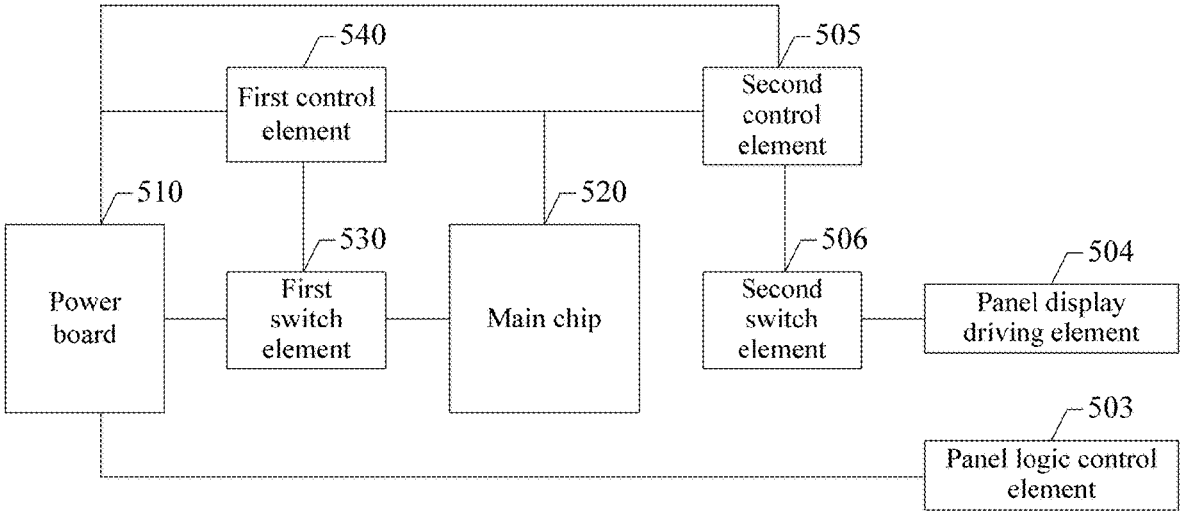
FIG. 9A illustrates a schematic diagram of an OLED display device according to some still other embodiments of the application.

In order to address the technical problem as mentioned above, further to the respective embodiments of the application, an embodiment of the application provides an OLED display device as illustrated in FIG. 9A, where the OLED display device includes a power board 510 and a main chip 520, and further includes a panel logic control element 503, a panel display driving element 504, a second control element 505, and a second switch element 506.

The second control element 505 is connected respectively with the power board 510, the main chip 520, and the second switch element 506, and is configured to output a first control signal upon reception of a first input signal for indicating the power board being AC-powered off, or a second input signal for indicating the main chip being DC-powered off.

The second switch element 506 is in connection with the panel display driving element, and configured to control the panel display driving element display, upon reception of the first control signal output from the second control element.

In the OLED display device as illustrated in FIG. 9A, the second control element is connected respectively with the power board and the main chip, the second control element may receive both the signal for indicating the power board being AC-powered or off, and the signal for indicating the main chip being DC-powered on or off, and output a corresponding control signal upon reception of a specified signal.

Upon reception of the first input signal for indicating the power board being AC-powered off, or the second input signal for indicating the main chip being DC-powered off, the second control element outputs the first control signal which is a signal for the second switch element to control the panel display driving element to discharge, and the second switch element controls the panel display driving element to discharge, upon reception of the first control signal.

In the embodiments of the application, the OLED display device receives the signals output from the power board and the main chip respectively through the second control element, and if the first input signal for indicating the power board being AC-powered off, or the second input signal for indicating the main chip being DC-powered off, the panel display driving element will be controlled by the second switch element to discharge so that as long as the power board is AC-powered off, or the main chip is DC-powered off, the driving element will be discharged, thus there is no afterimage in any scenario.

In order to enable the second control element to output the first control signal for controlling the panel display driving element to power off, in an embodiment further to the respective embodiments of the application above, the second control element includes a logic AND gate.

The logic AND gate has an input terminal in connection with the power board, the other input terminal in connection with the main chip, and an output terminal in connection with the second switch element.

In order to cause the main chip to power off in response to the first control signal, the second switch element includes a second switch.

The second switch is in connection with the panel display driving element and the ground, respectively.

In order to cause both the power board and the main chip to control the panel display driving element to discharge, the second control element includes the logic AND gate with two input terminals and one output terminal, where one of the input terminals of the logic AND gate is in connection with the power board, the other input terminal thereof is in connection with the main chip, and the output terminal thereof is in connection with the second switch element. There is such a control logic of the logic AND gate circuit that only if a high level is input to both of the input terminals, then a high level will be output; otherwise, a low level will be output.

While the OLED display device is operating normally, both the power board and the main chip are powered off, that is, the control signal output through the logic AND gate is at a high level, but the panel display driving element is not required to discharge at this time, so the second switch arranged in the second switch element is turned on at a high level so that the OELD display device may operate normally. The second switch has a terminal in connection with the panel display driving element, and in order to enable the panel display driving element to discharge rapidly, the second switch has the other terminal in connection with the ground.

Particularly the second control element and the second switch element in the embodiments of the application operate according to the following process.

While the OLED display device is operating normally, both the power board and the main chip are powered on, that is, both the AC power-on detection signal AC_DET and the DC power-on detection signal DC_DET of the power board are at a high level, that is, a high level is input to both of the input terminals of the logic AND gate, and at this time, there is such a control logic of the logic AND gate that a high level is output, and the second switch is turned on at a high level, so the panel display driving element is not discharged. If the Standby button is pressed down for standby, both AC_DET and DC_DET will be at a low level at this time, so a low level is output through the logic AND gate, and at this time, the second switch is turned off, and the panel display driving element is discharged rapidly.

If the OLED display device is AC-powered off suddenly after it is started, AC_DET will be at a low level at this time, and since the electrolytic capacitors are discharged, DC_DET is at a high level, so a low level is output through the logic AND gate, and the second switch is turned off, that is, the panel display driving element may be discharged rapidly to thereby prevent an afterimage from occurring when the OLED display device is AC-powered off suddenly. If the system of the OLED display device is upgraded or reset to its factory setting, the OLED display device will not be AC-powered off at this time, that is, AC_DET is at a high level, but the main chip will be operating abnormally, that is, DC_DET is at a low level, so still a low level is output to the logic AND gate, and the panel display driving element is discharged rapidly so that even if the system of the OLED display device is upgraded or reset to its factory setting, the panel display driving element will be controlled to discharge rapidly to thereby avoid an afterimage from occurring. Particularly the logic AND gate and the second switch may control the panel display driving element to discharge, as depicted in Table 3.

TABLE 3

A logic relationship between AC_DETECT (AC_DET), DC_DETECT (DC_DET), a switch state, and a discharge state

| Input 1(AC_DET) | Input 2(DC_DET) | The state of the switch | Discharged or not |
|---|---|---|---|
| L | L | OFF | Discharged |
| L | H | OFF | Discharged |
| H | L | OFF | Discharged |
| H | H | ON | Not discharged |

Here L represents a low level, and H represents a high level.

In the embodiments of the application, the second control element is provided with a logic AND gate so that the first control signal for controlling the panel display driving element to power off is output, and the second switch element is arranged with a switch to control the panel display driving element to discharge.

Figure 9B:
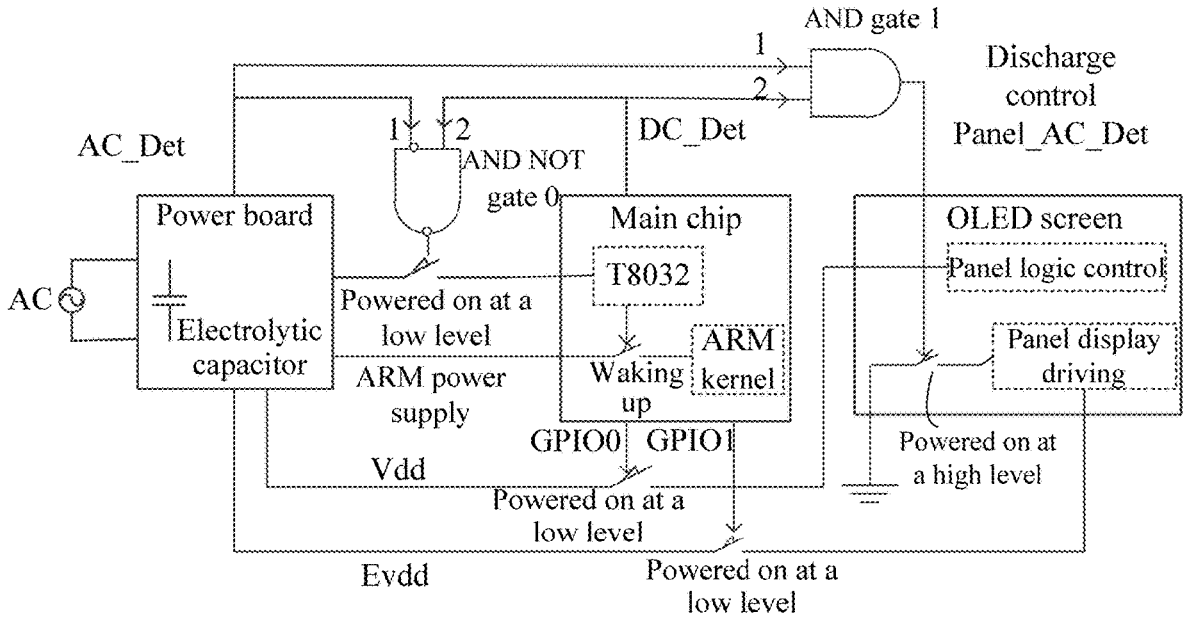
FIG. 9B illustrates a schematic scheme structural diagram of an OLED display device according to some embodiments of the application.

The OLED display device will be described below in details with reference to embodiment shown in FIG. 9B. FIG. 9B illustrates a schematic scheme structural diagram of the OLED display device, where the device includes a power board, a main chip including a T8032 chip and an ARM chip, OLED panel including a panel display driving element and a panel logic control element, a second control element including an AND gate 1, a first control element including an AND NOT gate 0, a second switch element, and a first switch element.

The scheme structure of the OLED display device will be described below in connection with three processes: a first process where the OLED display device is started normally; a second process where the OLED display device is on normal DC standby; and a third process where the OLED display device is AC-powered off after getting started.

Figure 9C:
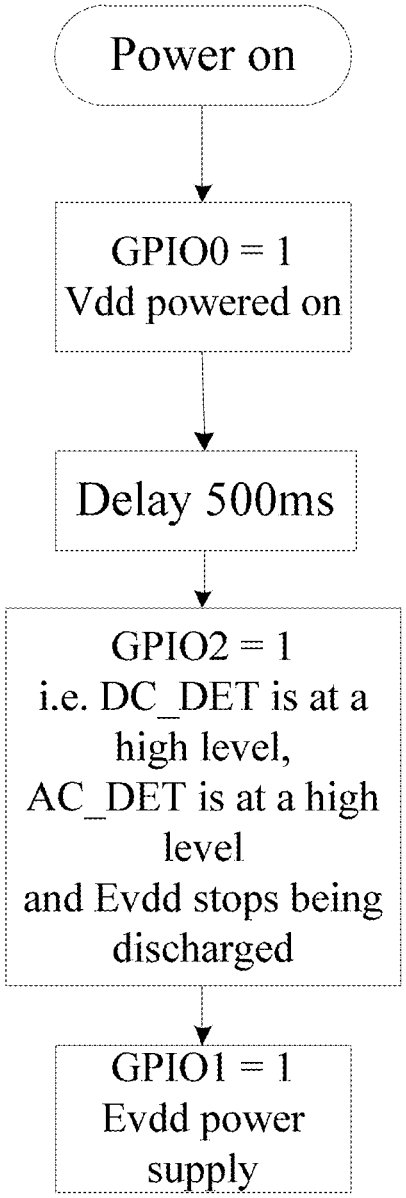
FIG. 9C illustrates a flow chart of powering on an OLED panel during a normal startup according to some embodiments of the application.

FIG. 9C illustrates a flow chart of powering on an OLED panel during a normal startup according to some embodiments of the application.

Figure 9D:
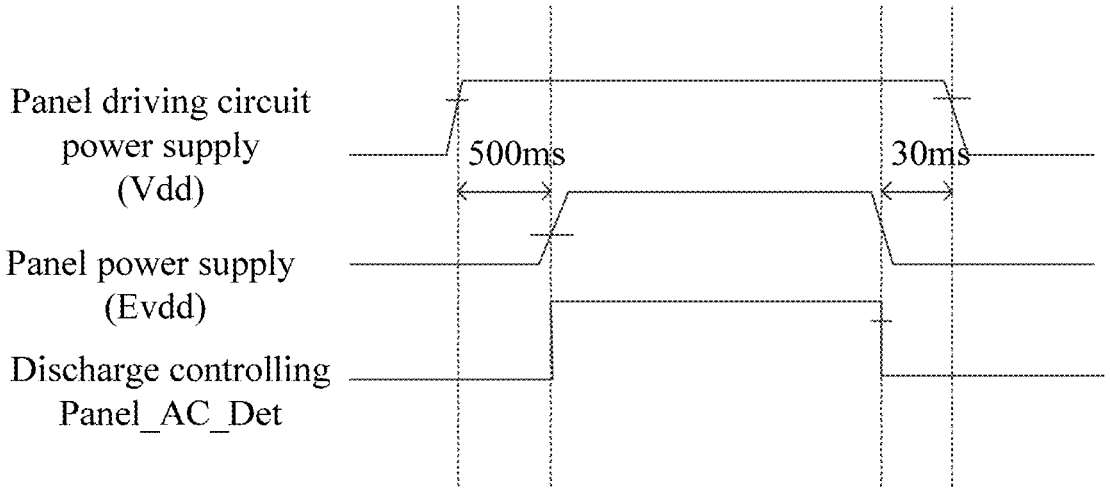
FIG. 9D illustrates a timing diagram of powering on an OLED panel according to some embodiments of the application.

Before the OLED display device is AC-powered on, AC_DET is at a low level, and DC_DET is also at a low level by default, so a high level is output through the AND NOT gate 0 at this time, that is, a switch of the T8032 chip is controlled to cut off, and at this time, the T8032 chip is powered normally. After the OLED display device is started, AC_DET is changed to a high level, so the main chip may set a pin GPIO 0 to a high level to control the panel logic control element to power on the OLED panel Vdd. As illustrated in FIG. 9D which is a timing diagram of powering on the OLED panel, the main chip controls GPIO 2 (DC_DET) to set to a high level after 500 ms, so the AND gate 1 controls a discharge pin Panel AC_DET of the panel display driving element to change to a high level, the panel is stopped from being discharged, and finally the pin GPIO 1 for controlling the panel display driving element to power on is pulled up to thereby power on Evdd so that the OLED panel is powered normally.

Figure 9E:
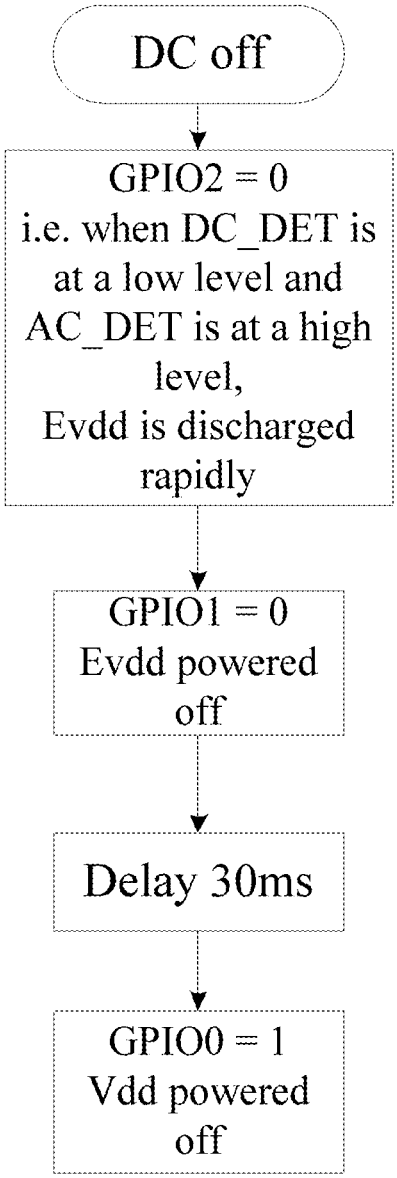
FIG. 9E illustrates a flow chart of powering off an OLED panel during a normal DC standby of an OLED display device according to some embodiments of the application.

FIG. 9E illustrates a flow chart of powering off the OLED panel during a normal DC standby of the OLED display device.

Upon reception of the standby signal through pressing down the POWER button on the remote controller, the OLED display device performs a startup flow. At this time, the main chip firstly sets GPIO 2 (DC_DET) to a low level, and at this time, the OLED display device is not AC-powered off, and AC_DET is at a high level, so Panel AC_DET is changed to a low level according to the control logic of the AND gate 1, and discharged rapidly, and also the panel display driving element power terminal Evdd is pulled down. After the panel display driving element is discharged completely, that is, after 30 ms, the panel logic control element power terminal Vdd is pulled down so that the panel logic control element is powered off normally. After the standby, the ARM chip is also powered off, and only the T8032 chip is operating and waiting for the waking source to wake up the ARM chip.

Figure 9F:
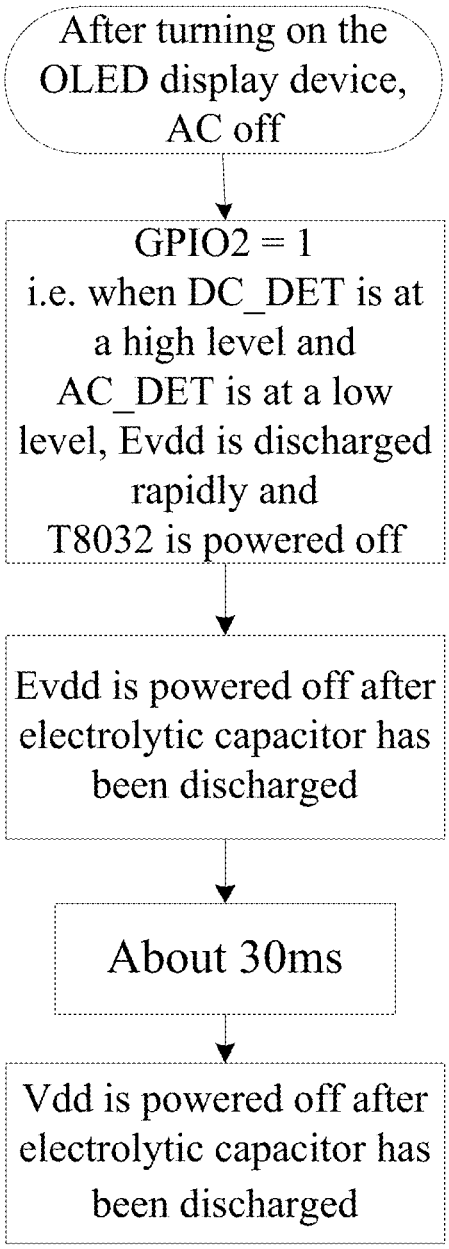
FIG. 9F illustrates a flow chart of rapid discharging by a display driving element of an OLED panel when an OLED display device is started and AC-powered off according to some embodiments of the application.

FIG. 9F illustrates a flow chart of rapid discharging by a display driving element of an OLED panel when an OLED display device is AC-powered off after getting started according to some embodiments of the application.

After the OLED display device is started normally, AC_DET is at a high level, and DC_DET is also at a high level, and if the OLED display device is AC-powered off suddenly, AC_DET will be changed to a low level, which is inverted by the NOT gate so that a high level is input to one terminal of the AND NOT gate 0. When the OLED display device is AC-powered off, the electrolytic capacitors of the power board are discharged so that DC_DET is at a high level, so a high level is input to the other terminal of the AND NOT gate 0, and a low level is output according to the control logic of the AND NOT gate 0, that is, T8032 is powered off, so that after the OLED display device is AC-powered on again, T8032 is powered on again, and then the OLED display device is woken, therefore avoiding a phenomenon where the OLED display device is not woken. Also since two input terminals of the AND gate 1 are connected respectively with AC_DET and DC_DET, AC_DET is changed to a low level, and DC_DET is still at a high level when the OLED display device is AC-powered off, so a low level is output by the AND gate 0, and the second switch in the second switch element is off, so that the panel display driving element is discharged rapidly, thus avoiding an afterimage from occurring when the OLED display device is AC-powered off. Since there is a limited storage capacity of the panel display driving element, the panel logic control element power terminal Vdd is pulled down after the panel display driving element is discharged completely, for example, after 30 ms, the panel logic control element is powered off normally.

Figure 10:
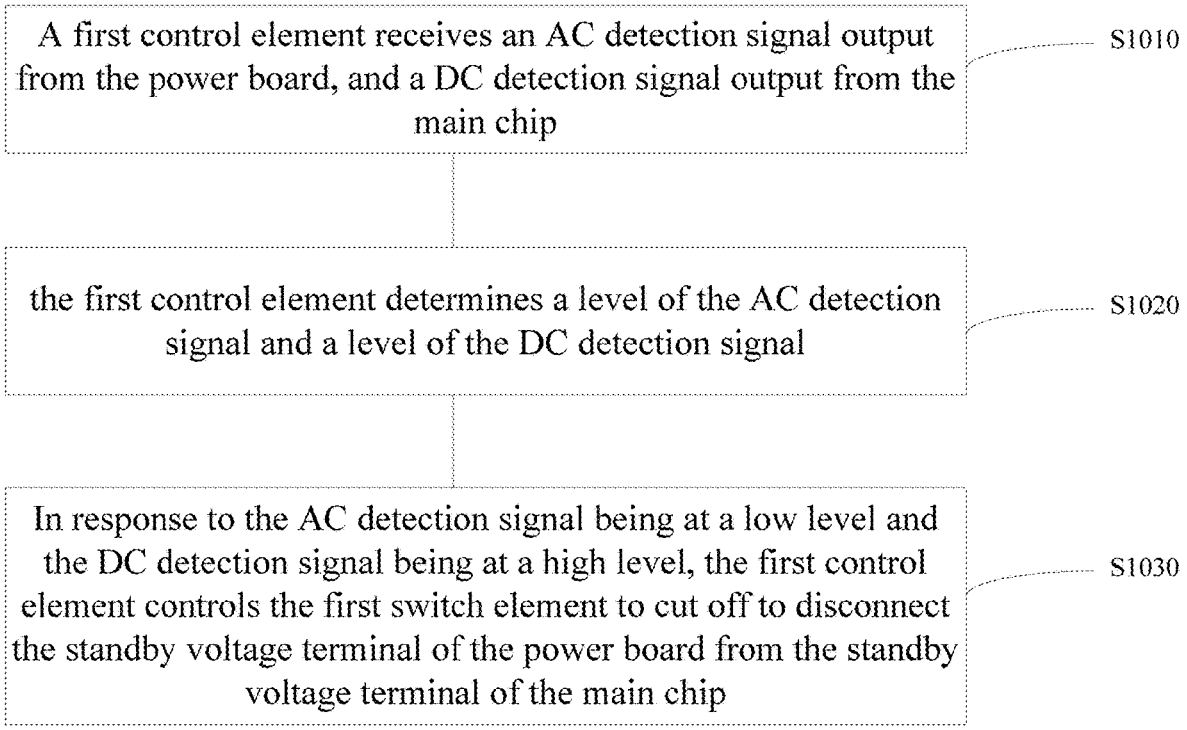
FIG. 10 illustrates a schematic flow chart of a method for controlling the OLED display device according to some embodiments of the application.

Some embodiments of the application further provide a method for controlling the OLED display device above. As illustrated in FIG. 10, the method for controlling the OLED display device includes the following operations.

The operation S1010: a first control element receives an AC detection signal output from the power board, and a DC detection signal output from the main chip, where the first control element is electrically in connection with a first switch element, a power board and a main chip of the OLED display device respectively.

The operation S1020: the first control element determines a level of the AC detection signal and a level of the DC detection signal.

The operation S1030: in response to the AC detection signal being at a low level and the DC detection signal being at a high level, the first control element controls the first switch element to cut off to disconnect the standby voltage terminal of the power board from the standby voltage terminal of the main chip, where the first switch element is electrically in connection with a standby voltage terminal of the power board and a standby voltage terminal of the main chip respectively.

In some embodiments of the application, the method for controlling the OLED display device further includes: if an AC-power-off signal, e.g., a power switch-off signal, is received during power up state of the OLED display device (e.g., after the OLED display device is started), changing the AC detection signal from a high level to a low level, and controlling the first switch element to cut off, so that the DC detection signal is changed from a high level to a low level.

In some embodiments of the application, the method for controlling the OLED display device further includes: if an AC-power-on signal, e.g., a power source switch-on signal, is received during power off state (for example, after the OLED display device is turned off), changing the AC detection signal from a low level to a high level, and controlling the first switch element to turn on, so that the DC detection signal is changed from a low level to a high level.

In some embodiments of the application, the method for controlling the OLED display device further includes: if a DC power-off signal, e.g., a standby signal sent from the remote controller, is received during power up state (for example, after the OLED display device is started), changing the DC detection signal from a high level to a low level, and then changing the AC detection signal from a high level to a low level, and keeping the first switch element turned on.

In some embodiments of the application, the method for controlling the OLED display device further includes: if a DC power-on signal, e.g., a startup signal sent from the remote controller, is received while the OLED display device is on standby, changing the AC detection signal from a low level to a high level, and controlling the first switch element to turn on, and then changing the DC detection signal from a low level to a high level.

In the method for controlling the OLED display device as illustrated in FIG. 10, on one hand, while the OLED display device is AC-powered off, the first switch element is controlled to cut off by the AC detection signal, so that the 5 V standby voltage is disconnected rapidly. While the OLED display device is DC-powered off, the DC detection signal is changed from a high level to a low level, and then the AC detection signal is changed from a high level to a low level, and the first switch element is kept switched on, so that the OLED display device may enter into a normal standby while it is DC-powered off. On the other hand, the 5 V standby voltage is disconnected rapidly when the OLED display device is AC-powered off, so that the OLED display device may be started normally when it is AC-powered on.

Furthermore some embodiments of the application provide an electronic device including: a processor; and a memory storing computer readable instructions configured, upon being executed by the processor, to perform the method above for controlling the OLED display device.

The principle of the embodiments of the system or the device is substantially the same as the embodiments of the method, so the embodiments of the system or the device have been described in brevity, and reference may be made to the embodiments of the method for details thereof.

It shall be noted that in this context, the relationship terms, e.g., "first", "second", etc., are only intended to distinguish one entity or operation from another entity or operation, but not intended to require or suggest any such a real relationship or order between these entities or operations.

Those skilled in the art shall appreciate that the embodiments of the application may be embodied as a method, a system or a computer program product. Therefore the application may be embodied in the form of an all-hardware embodiment, an all-software embodiment or an embodiment of software and hardware in combination. Furthermore the application may be embodied in the form of a computer program product embodied in one or more computer useable storage mediums (including but not limited to a disk memory, a CD-ROM, an optical memory, etc.) in which computer useable program codes are contained.

The application has been described in a flow chart and/or a block diagram of the method, the device (system) and the computer program product according to the embodiments of the application. It shall be appreciated that respective flows and/or blocks in the flow chart and/or the block diagram and combinations of the flows and/or the blocks in the flow chart and/or the block diagram may be embodied in computer program instructions. These computer program instructions may be loaded onto a general-purpose computer, a specific-purpose computer, an embedded processor or a processor of another programmable data processing device to produce a machine so that the instructions executed on the computer or the processor of the other programmable data processing device create means for performing the functions specified in the flow(s) of the flow chart and/or the block(s) of the block diagram.

These computer program instructions may also be stored into a computer readable memory capable of directing the computer or the other programmable data processing device to operate in a specific manner so that the instructions stored in the computer readable memory create an article of manufacture including instruction means which perform the functions specified in the flow(s) of the flow chart and/or the block(s) of the block diagram.

These computer program instructions may also be loaded onto the computer or the other programmable data processing device so that a series of operational operations are performed on the computer or the other programmable data processing device to create a computer implemented process so that the instructions executed on the computer or the other programmable device provide operations for performing the functions specified in the flow(s) of the flow chart and/or the block(s) of the block diagram.

Although the preferred embodiments of the application have been described, those skilled in the art benefiting from the underlying inventive concept may make additional modifications and variations to these embodiments. Therefore the appended claims are intended to be construed as encompassing the preferred embodiments and all the modifications and variations coming into the scope of the application.

Evidently those skilled in the art may make various modifications and variations to the application without departing from the spirit and scope of the application. Thus the application is also intended to encompass these modifications and variations thereto so long as the modifications and variations come into the scope of the claims appended to the application and their equivalents.

The invention claimed is:

1. An Organic Light-Emitting Diode (OLED) display device, comprising:

a power board;

a main chip; wherein the power board is configured to output a standby power voltage to power the main chip, output a first power voltage to power a display panel and output a second power voltage to power a Timer Control Register (TCON); wherein the first power voltage is equal to the second power voltage, and both the first power voltage and the second power voltage are greater than the standby power voltage; wherein when the power board in an AC-powered on mode, the OLED display device is AC-powered on, or when the power board in a low-power standby mode, the OLED display device is on standby and the power board is only output a standby power voltage to power the main chip; wherein the power board arranged with a large number of electrolytic capacitors for being discharged to maintain an output power supply; wherein the power board is configured to output an AC detection signal, the AC detection signal is at a high level when the OLED display device is AC-powered on, and the AC detection signal is at a low level when the OLED display device is AC-powered off;

a first switch circuit, electrically connected with a standby voltage terminal of the power board, and a standby voltage terminal of the main chip, respectively, and configured to control the standby voltage terminal of the power board to connect with or disconnect from the standby voltage terminal of the main chip, wherein the standby voltage terminal of the power board is configured to output the standby power voltage, the standby voltage terminal of the main chip is configured to receive the standby power voltage; and a first control circuit, electrically connected with the first switch circuit, the power board, and the main chip, respectively, and configured to receive the AC detection signal output from the power board, and a DC detection signal output from the main chip, and control the first switch circuit to turn on or cut off;

wherein the AC detection signal is a signal for indicating alternating current being switched on or off, and the DC detection signal is a signal for indicating direct current being switched on or off;

wherein the first switch circuit comprises a first transistor, and the first control circuit comprises a second transistor, a third transistor, and a fourth transistor, wherein:

the first transistor comprises a control terminal electrically connected with a first terminal of the second transistor, a first terminal electrically connected with the standby voltage terminal of the power board, and a second terminal electrically connected with the standby voltage terminal of the main chip;

the second transistor comprises a control terminal electrically connected with a second terminal of the third transistor, and a second terminal grounded, wherein the control terminal of the second transistor is configured to receive the AC detection signal;

the third transistor comprises a control terminal electrically connected with a first terminal of the fourth transistor, and a first terminal electrically connected with the standby voltage terminal of the power board; and the fourth transistor comprises a control terminal electrically connected with an output terminal of the main chip, a second terminal grounded, and the control terminal configured to receive the DC detection signal.

2. The OLED display device according to claim 1, wherein the first transistor is an MOS transistor, and the second transistor, the third transistor, and the fourth transistor are triodes.

3. The OLED display device according to claim 2, wherein the first transistor is a P-type MOS transistor, and the second transistor, the third transistor, and the fourth transistor are NPN-type triodes.

4. The OLED display device according to claim 1, wherein the first control circuit further comprises a diode with a first terminal configured to receive the AC detection signal, and a second terminal electrically connected with the control terminal of the second transistor.

5. The OLED display device according to claim 1, wherein the OLED display device further comprises a panel logic control circuit, a panel display driving element, a second switch circuit, and a second control circuit, wherein:

the second control circuit is connected with the power board, the main chip, and the second switch circuit respectively, and configured to output a first control signal upon reception of a first input signal for indicating the power board being AC-powered off, or a second input signal for indicating the main chip being DC-powered off; and the second switch circuit is connected with the panel display driving element, and configured to control the panel display driving element to discharge, upon reception of the first control signal output from the second control circuit.

6. The OLED display device according to claim 5, wherein the second control circuit comprises a logic AND gate with a first input terminal connected with the power board, a second input terminal connected with the main chip, and an output terminal connected with the second switch circuit.

7. The OLED display device according to claim 5, wherein the second switch circuit comprises a second switch connected with the panel display driving element and a ground terminal respectively.

8. A method for controlling an OLED display device, the method comprising:

receiving, by a first control circuit electrically connected with a first switch circuit, a power board and a main chip of the OLED display device respectively, an AC detection signal output from the power board, and a DC detection signal output from the main chip;

determining, by the first control circuit, a level of the AC detection signal and a level of the DC detection signal;

in response to the AC detection signal being at a low level and the DC detection signal being at a high level, controlling, by the first control circuit, the first switch circuit electrically connected with a standby voltage terminal of the power board and a standby voltage terminal of the main chip respectively to cut off to disconnect the standby voltage terminal of the power board from the standby voltage terminal of the main chip;

wherein the power board is configured to output a standby power voltage to power the main chip; output a first power voltage to power a display panel and output a second power voltage to power a Timer Control Register (TCON); wherein the first power voltage is equal to the second power voltage, and both the first power voltage and the second power voltage are greater than the standby power voltage;

wherein the standby voltage terminal of the power board is configured to output the standby power voltage, the standby voltage terminal of the main chip is configured to receive the standby power voltage;

wherein when the power board in an AC-powered on mode, the OLED display device is AC-powered on, or when the power board in a low-power standby mode, the OLED display device is on standby and the power board is only output a standby power voltage to power the main chip;

wherein the power board arranged with a large number of electrolytic capacitors for being discharged to maintain an output power supply; wherein the power board is configured to output the AC detection signal, the AC detection signal is at a high level when the OLED display device is AC-powered on, and the AC detection signal is at a low level when the OLED display device is AC-powered off;

wherein the first switch circuit comprises a first transistor, and the first control circuit comprises a second transistor, a third transistor, and a fourth transistor, wherein:

the first transistor comprises a control terminal electrically connected with a first terminal of the second transistor, a first terminal electrically connected with the standby voltage terminal of the power board, and a second terminal electrically connected with the standby voltage terminal of the main chip;

the second transistor comprises a control terminal electrically connected with a second terminal of the third transistor, and a second terminal grounded, wherein the control terminal of the second transistor is configured to receive the AC detection signal;

the third transistor comprises a control terminal electrically connected with a first terminal of the fourth transistor, and a first terminal electrically connected with the standby voltage terminal of the power board; and the fourth transistor comprises a control terminal electrically connected with an output terminal of the main chip, a second terminal grounded, and the control terminal configured to receive the DC detection signal.

9. The method for controlling the OLED display device according to claim 8, further comprising:

during power up state of the OLED display device, upon receiving an AC-power-off signal, changing the AC detection signal from a high level to a low level, and controlling the first switch circuit to cut off, to enable the DC detection signal to change from a high level to a low level.

10. The method for controlling the OLED display device according to claim 8, further comprising:

during power off state of the OLED display device, upon receiving an AC-power-on signal, changing the AC detection signal from a low level to a high level, and controlling the first switch circuit to turn on, to enable the DC detection signal to change from a low level to a high level.

11. The method for controlling the OLED display device according to claim 8, further comprising:

during power up state of the OLED display device, upon receiving a DC power-off signal, changing the DC detection signal from a high level to a low level, changing the AC detection signal from a high level to a low level, and maintaining the first switch circuit turned on.

12. The method for controlling the OLED display device according to claim 8, further comprising:

during standby state of the OLED display device, upon receiving a DC power-on signal, changing the AC detection signal from a low level to a high level, controlling the first switch circuit to turn on, and changing the DC detection signal from a low level to a high level.

* * * * *